US012304701B1

(12) United States Patent
Schweet et al.

(10) Patent No.: US 12,304,701 B1
(45) Date of Patent: May 20, 2025

(54) RECYCLABLE COFFEE CUP WITH INTEGRATED LID

(71) Applicant: SAEC/Kinetic Vision, Inc., Cincinnati, OH (US)

(72) Inventors: Richard R. Schweet, Summerlin, NV (US); James A. Topich, Mason, OH (US); Joshua J. Haldeman, Loveland, OH (US); Michael J. Palmisano, Cincinnati, OH (US); Geoffrey A. King, London, OH (US); Brent P. Vorst, Ottawa, OH (US)

(73) Assignee: SAEC/Kinetic Vision, Inc., Cincinnati, OH (US)

( * ) Notice: Subject to any disclaimer, the term of this patent is extended or adjusted under 35 U.S.C. 154(b) by 0 days.

(21) Appl. No.: 18/911,673

(22) Filed: Oct. 10, 2024

Related U.S. Application Data

(60) Provisional application No. 63/623,872, filed on Jan. 23, 2024.

(51) Int. Cl.
*B65D 43/16* (2006.01)
*B65D 21/02* (2006.01)

(52) U.S. Cl.
CPC ..... *B65D 43/162* (2013.01); *B65D 21/0233* (2013.01); *B65D 2251/1016* (2013.01)

(58) Field of Classification Search
CPC ..... B65D 43/162; B65D 21/0233; B65D 2251/1016
USPC ..... 220/375, 839
See application file for complete search history.

(56) References Cited

U.S. PATENT DOCUMENTS 3,194,468 A * 7/1965 Baron ..... B65D 1/265 220/675
3,587,944 A * 6/1971 Pehr ..... B65D 83/06 220/259.2
5,224,623 A * 7/1993 LaFleur ..... B65D 21/0233 206/217
9,737,161 B1 8/2017 Li
2010/0288769 A1 11/2010 Cheng et al.
(Continued)

FOREIGN PATENT DOCUMENTS

AU 2020366478 A1 5/2022
EP 1317380 B1 12/2004
(Continued)

OTHER PUBLICATIONS

Peters, Adele; "This foldable coffee cup cleverly eliminates the plastic lid"; Fast Company; Feb. 27, 2023; downloaded from https://www.fastcompany.com/90854431/this-foldable-coffee-cup-cleverly-eliminates-the-plastic-lid; 3 pages.
(Continued)

*Primary Examiner* — James N Smalley
(74) *Attorney, Agent, or Firm* — Frost Brown Todd LLP

(57) ABSTRACT

A disposable cup with an integrated hinged lid is provided. The disposable cup can be unitarily formed entirely of a wood, cellulosic, or other type of fiber pulp-based material that is readily recyclable using a single recycling process for the entire product. The entire product can be recycled using the same recycling process, as compared to conventional disposable cups which can require the separation of the product into its various components, each of which may require a different type of recycling process.

18 Claims, 33 Drawing Sheets

(56) References Cited

U.S. PATENT DOCUMENTS

| | | | | |
|---|---|---|---|---|
| 2011/0180552 | A1 | 7/2011 | Sarson | |
| 2015/0329255 | A1* | 11/2015 | Rzepecki | B65D 43/16 222/545 |
| 2018/0215517 | A1 | 8/2018 | Vovan et al. | |
| 2019/0375560 | A1 | 12/2019 | Tobias | |
| 2024/0076105 | A1* | 3/2024 | Kuo | B65D 47/06 |

FOREIGN PATENT DOCUMENTS

| | | | |
|---|---|---|---|
| JP | 2019210055 | A | 12/2019 |
| KR | 20190061323 | A | 6/2019 |
| KR | 20220096093 | A | 7/2022 |
| TW | 201034605 | A1 | 10/2010 |
| WO | 2011082486 | A1 | 7/2011 |
| WO | 2021073599 | A1 | 4/2021 |

OTHER PUBLICATIONS

Noe, Rain; "A Biodegradable/Recyclable Paper Coffee Cup with Integrated Lid and Spout"; Core77; Mar. 16, 2022; downloaded from https://www.core77.com/posts/113900/A-BiodegradableRecyclable-Paper-Coffee-Cup-with-Integrated-Lid-and-Spout; 8 pages.

SOFI Products; SOFi Cold Cup; downloaded from https://www.sofiproducts.com/products/8oz on Oct. 16, 2024; 12 pages.

Thomas, Shane; International Search Report and Written Opinion of the International Searching Authority; Int'l App. No. PCT/US2024/050692; Dec. 31, 2024; 15 pages.

* cited by examiner

RECYCLABLE COFFEE CUP WITH INTEGRATED LID

CROSS REFERENCE TO RELATED APPLICATIONS

This application claims the benefit of U.S. Ser. No. 63/623,872, filed on Jan. 23, 2024, and entitled RECYCLABLE COFFEE CUP WITH INTEGRATED LID, this disclosure of which is incorporated herein by reference in its entirety.

BACKGROUND

Disposable coffee cups are ubiquitous, with an estimated 500 billion used globally each year. However, the vast majority of these cups end up in landfills given difficulties and inefficiencies in recycling them. Most single-use coffee cups mix paper and plastic liners, contaminating recycling streams for both materials.

Specifically, standard disposable cups consist of paper and a thin internal polyethylene layer designed to prevent leakage. The polyethylene plastic coating allows the cup to hold liquid contents, but also prevents the paper portion from easily breaking down during typical paper recycling processes. Attempts to remove the lining at recycling facilities via friction and abrasion often fail to fully separate the materials. Any remaining pieces of plastic liner can severely disrupt or damage technical paper recycling equipment.

As a result, most municipal recycling centers do not accept single-use coffee cups. Waste audits consistently find disposable cups among the highest occurring items in landfill waste. Once buried in anaerobic landfill environments, both the paper and plastic components fail to fully decompose, persisting for decades.

A small minority of disposable cups get diverted to specialized facilities capable of separating and dealing with mixed waste streams. However, these specialized recycling processes come at very high economic and environmental costs due to the substantial transportation and intensive processing required.

In addition to cups, the majority of coffee and drink orders also include single-use plastic lids. These lids amplify harm as they utilize additional fossil fuel-derived polymers and complicate recycling. Coffee cup lids are commonly injection-molded from new polypropylene plastic. While technically recyclable, mixed waste collection systems and economic factors result in the vast majority being discarded rather than recycled.

In summary, ubiquitous mixed material disposable coffee cups along with vast numbers of plastic coffee lids overwhelm waste management systems, accumulate undecomposed in landfills, and represent an avoidable waste. The composite mixed materials and lack of infrastructure to collect, separate, and recycle every cup component result in the majority becoming pollution accumulating in landfills or the natural environment.

BRIEF DESCRIPTION OF THE DRAWINGS

The present disclosure will be more readily understood from a detailed description of some example embodiments taken in conjunction with the following figures.

DETAILED DESCRIPTION

Figure 1:
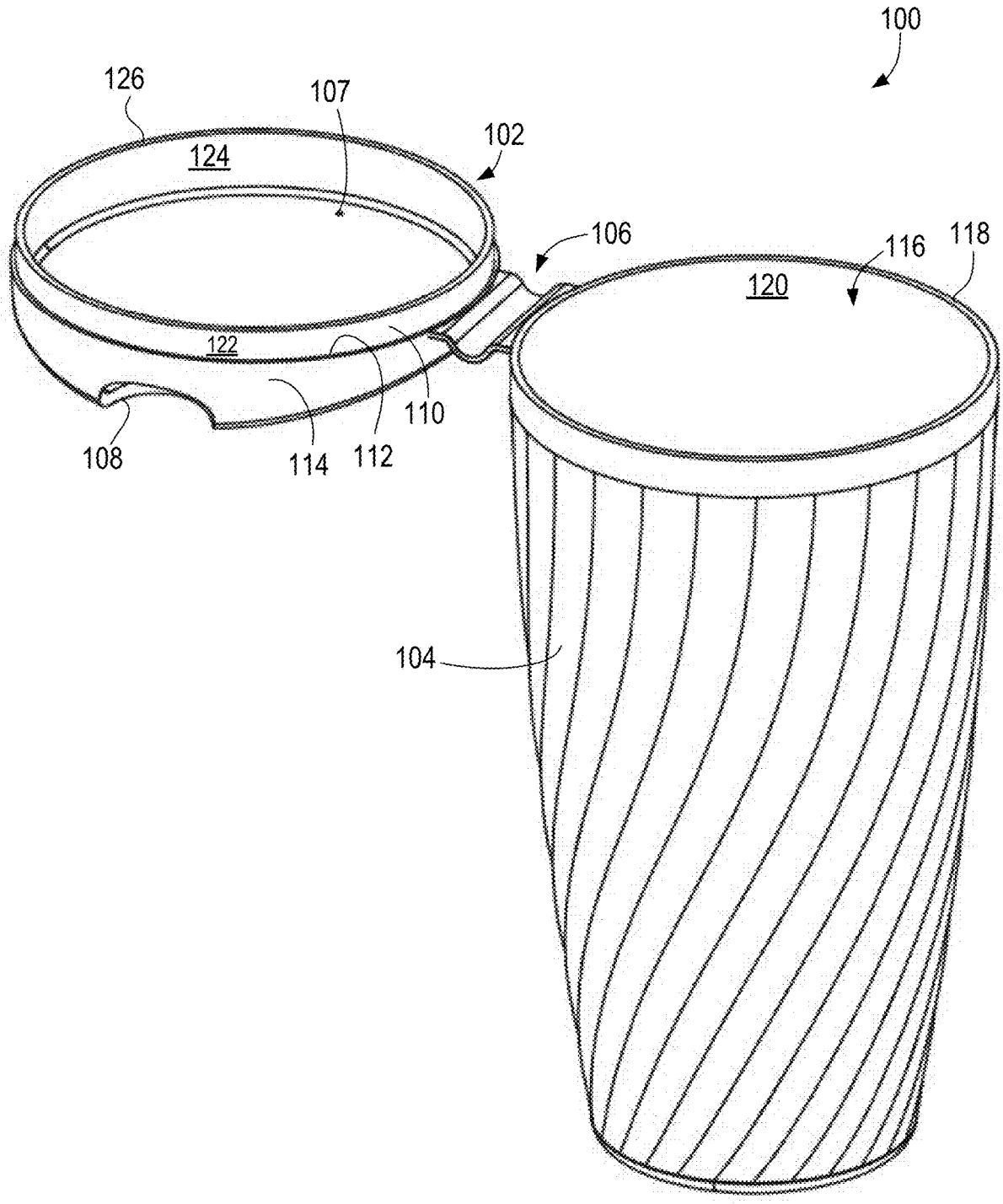
FIG. 1 depicts an example disposable cup with an integrated hinged lid in an open position in accordance with one non-limiting embodiment.

Various non-limiting embodiments of the present disclosure will now be described to provide an overall understanding of the principles of the structure, function, manufacture and use of the disposable cups with integrated lids as disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the disposable cups with integrated lids and method of manufacture described herein. None of the features or components shown in the drawings or discussed below should be taken as mandatory for any specific implementation of any of these disposable cups with integrated lids and methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible.

In accordance with the present disclosure, a disposable cup with integrated lid, sometimes referred to herein as a hinged disposable cup, can be unitarily formed entirely of a wood, cellulosic other type of fiber pulp-based material that is readily recyclable using a single recycling process for the entire product. As such, the entire product can be recycled using the same recycling process, as compared to conventional disposable cups which can require the separation of the product into its various components, each of which may require a different type of recycling process. The disposable cup of the present disclosure can be molded, or otherwise manufactured as a single integrated product. In accordance with various embodiments, the disposable cup does not include a polyethylene plastic coating. A hinge, such as a flexible living hinge, can connect the cup body and the lid allowing the lid to be selectively moved from an open position to a closed position. In some embodiments, a secondary operation can be utilized subsequent to the molding process that seeks to improve the functionality of the hinge. For example, in some embodiments, the hinge can be scored, perforated, or otherwise augmented by a knife operation or other process. The cup body can incorporate gently sloping walls and a tapered cylindrical shape allowing multiple cups to be nested into each other in a stacked configuration when the lids are positioned in an open position. While in the open position, the lids of adjacent cups can also stack, thereby allowing for a configuration that provides efficiencies in shipping and storage. Cups with integrated lids in accordance with the present disclosure can therefore provide a cup and lid product made from renewable wood pulp based materials that requires only a single recycling process for the entire product. In some embodiments, a disposable cup is provided with a separately attachable lid, but with both components still formed entirely of a wood, cellulosic other type of fiber pulp-based material that is readily recyclable using a single recycling process for the entire product.

Figure 2:
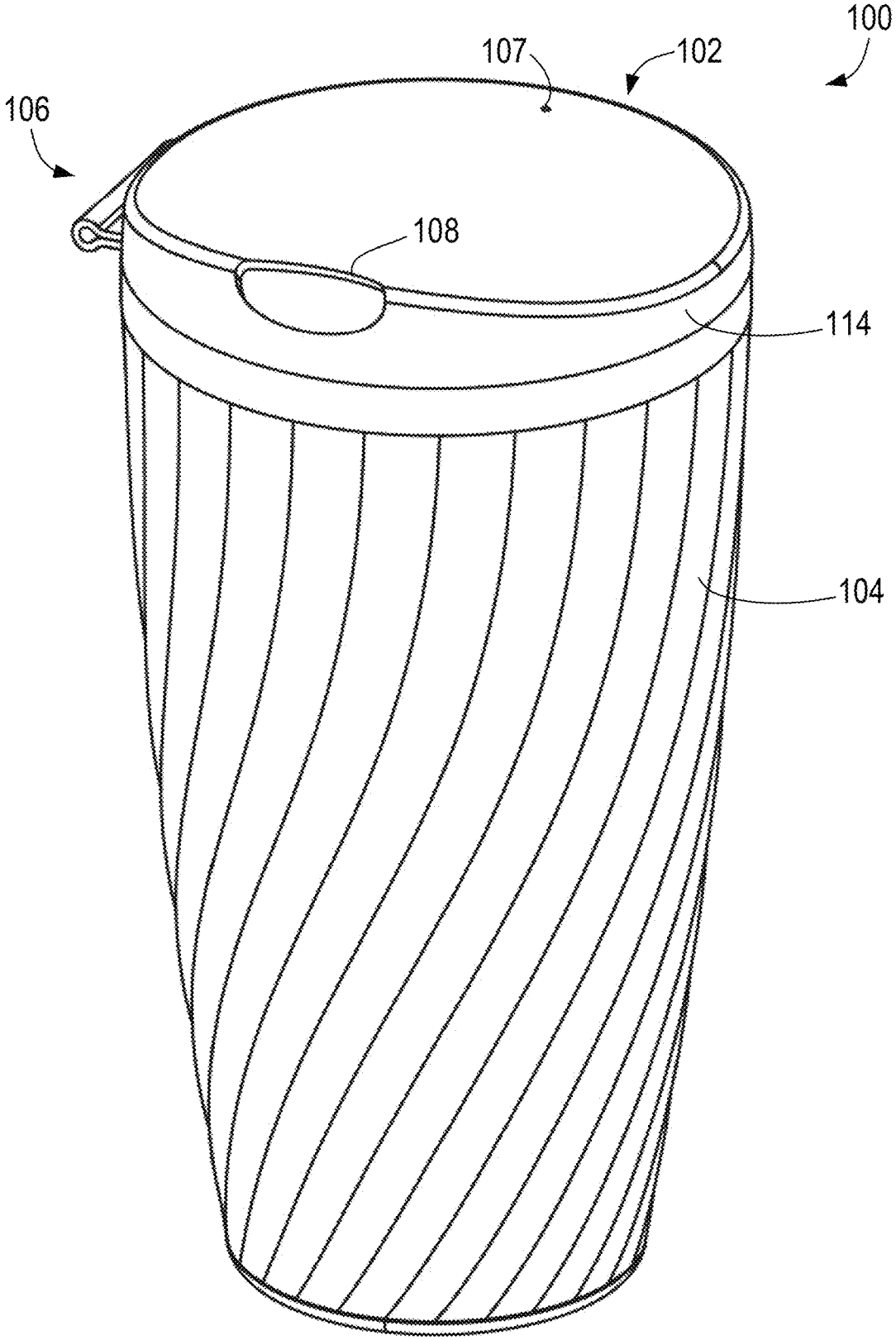
FIG. 2 depicts the example disposable cup with an integrated hinged lid of FIG. 1 in a closed position in accordance with one non-limiting embodiment.
Figure 3:
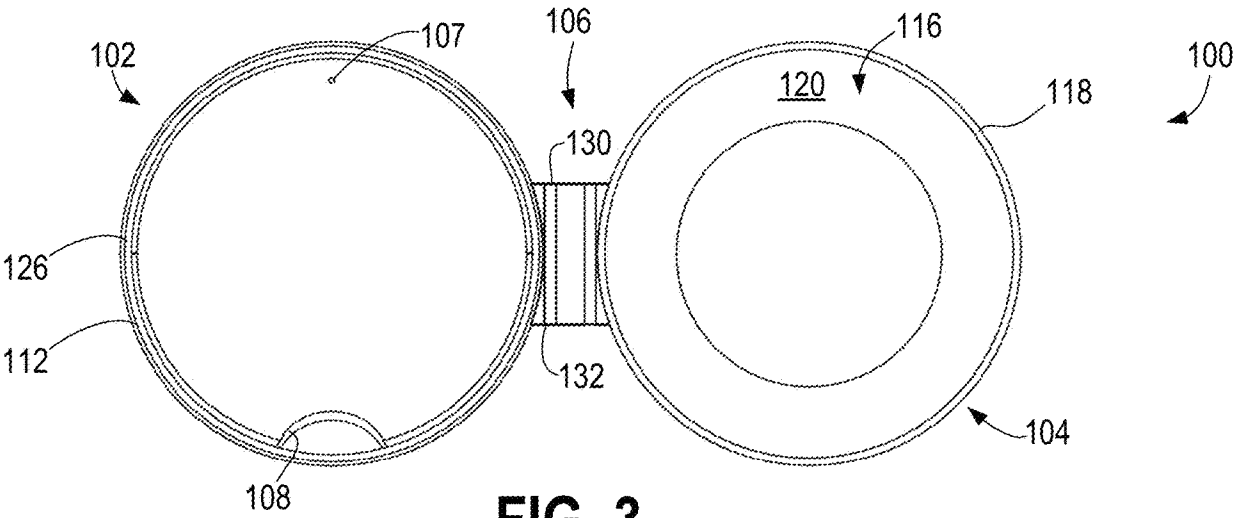
FIG. 3 depicts a top view of the example disposable cup with an integrated hinged lid of FIG. 1 in an open position in accordance with one non-limiting embodiment.
Figure 4:
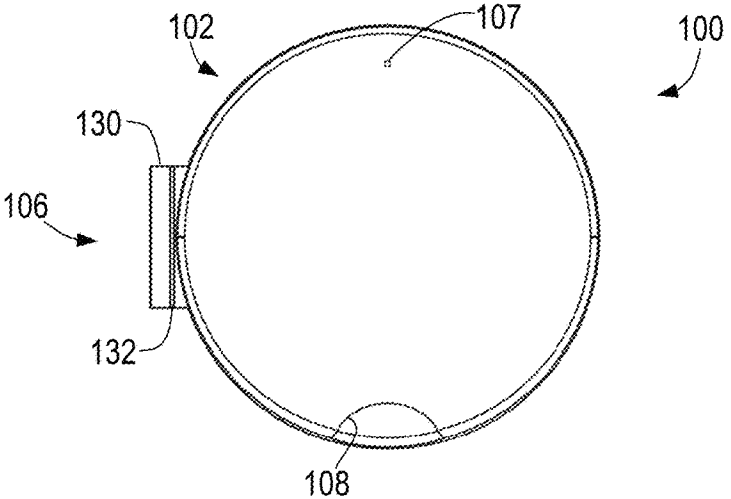
FIG. 4 depicts a top view of the example disposable cup with an integrated hinged lid of FIG. 1 in a closed position in accordance with one non-limiting embodiment.
Figure 6:
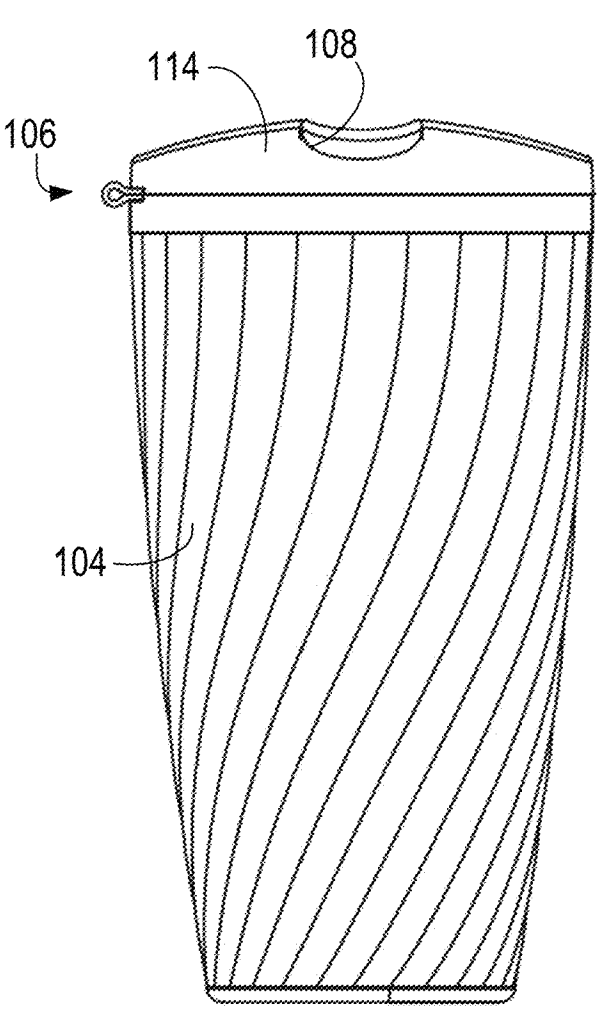
FIG. 6 depicts a side view of the example disposable cup with an integrated hinged lid of FIG. 1 in a closed position in accordance with one non-limiting embodiment.
Figure 5:
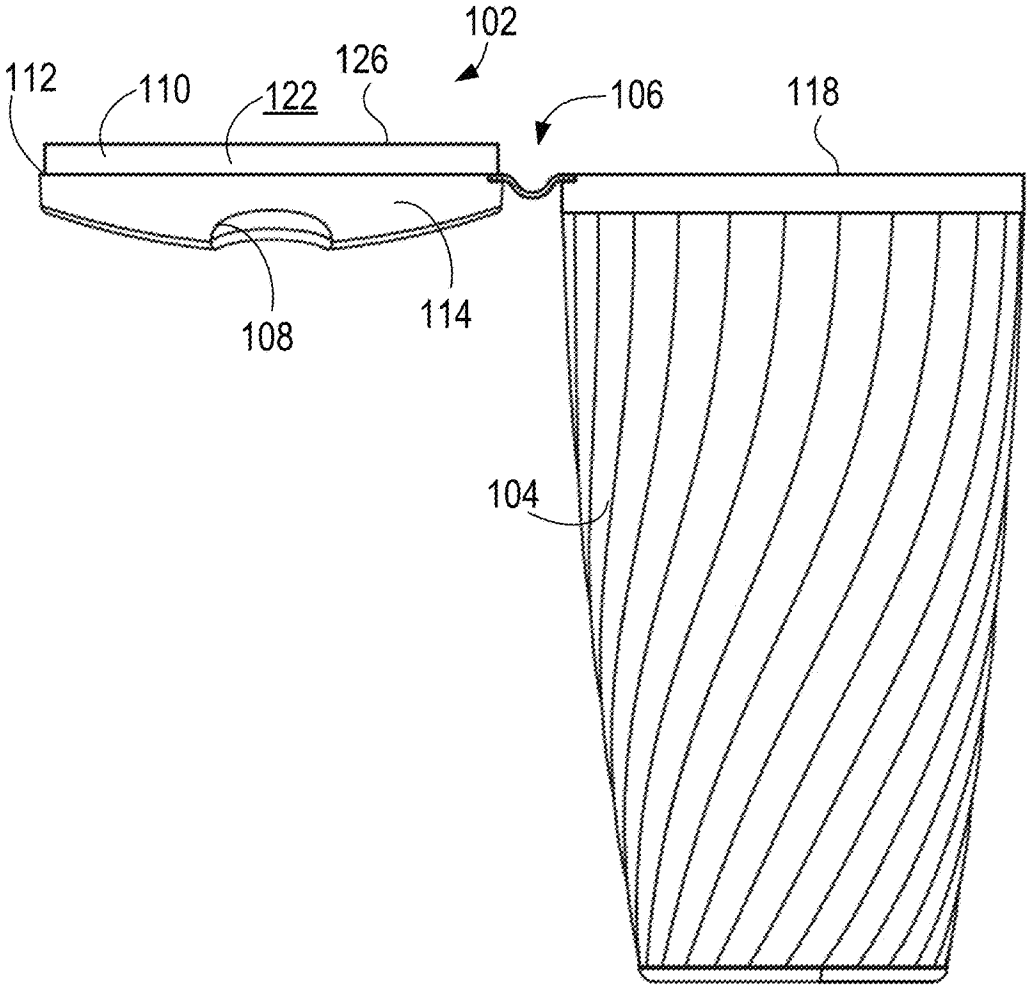
FIG. 5 depicts a side view of the example disposable cup with an integrated hinged lid of FIG. 1 in an open position in accordance with one non-limiting embodiment.

FIGS. 1-6 depict an example disposable cup 100 in accordance with one non-limiting embodiment. FIG. 1 depicts the disposable cup 100 with a hinged lid 102 in an open position while FIG. 2 depicts the hinged lid 102 in a closed position. FIGS. 3 and 4 depict top views of the disposable cup 100 in an open position (FIG. 3) and a closed position (FIG. 4). FIGS. 5 and 6 depict side views of the disposable cup 100 in an open position (FIG. 5) and a closed position (FIG. 6).

The disposable cup 100 can include a body portion 104 having an inner surface 120. The inner surface 120 of the body portion 104 can define a cavity 116 that is fillable with liquid. The body portion 104 can be unlined and manufactured from a molded cellulosic material, for example. While spiral flutes are illustrated on the external surface of the body portion 104 in FIGS. 1-6, this disclosure is not so limited. As is to be appreciated, in some embodiments the body portion 104 can be smooth sided, as shown below, or in other configurations.

The disposable cup 100 can include the hinged lid 102 that is coupled to the body portion 104 via a hinge 106. In some embodiments, the hinge 106 is a living hinge that joins the outer edge of the hinged lid 102 to the body portion 104. The hinge 106 can be an integrally molded component made from a thin, flexible molded cellulosic material that is formed to function as a pivoting joint between the body portion 104 and the hinged lid 102. More specifically, the hinge 106 can be a flexible web of material formed during the molding manufacturing process, with the lid, hinge, and body portion comprising one continuous unitary product rather than separate components that are fastened together. In some embodiments, the hinge 106 is generally planar with a first edge 130 and a second edge 132 extending between the body portion 104 and the hinged lid 102 in a parallel configuration (see FIG. 3). In other embodiments, however, the hinge 106 can have different configurations that allow for the functionality described herein. In any event, the hinge 106 can enable the hinged lid 102 to be repeatedly pivoted between an open and closed position while still retaining an attachment to the body portion 104.

In some embodiments, the hinged lid 102 can include an upper portion 114 that defines a spout 108 and an air vent 107. A lower portion 110 of the hinged lid can have a slightly smaller diameter than the upper portion 114, with the lower portion 110 and the upper portion 114 being separated by a shoulder 112 that surrounds the hinged lid 102. The shoulder 112 can have a width that is similar to the width of a rim 118 of the body portion 104. The hinge 106 can extend outwardly from the shoulder 112, as shown in FIG. 1.

In some embodiments, the lower portion 110 can have an inner surface 124 and an outer surface 122 that meet at a lid rim 126. When the hinged lid 102 is moved to a closed position, the lower portion 110 can be received into the body portion 104, such that the outer surface 122 of the hinged lid 102 is in frictional contact with the inner surface 120 of the body portion 104. The shoulder 112 of the hinged lid 102 can sit on the rim 118 of the body portion 104, such that a generally liquid tight seal is created between the hinged lid 102 and the body portion 104.

Figure 8:
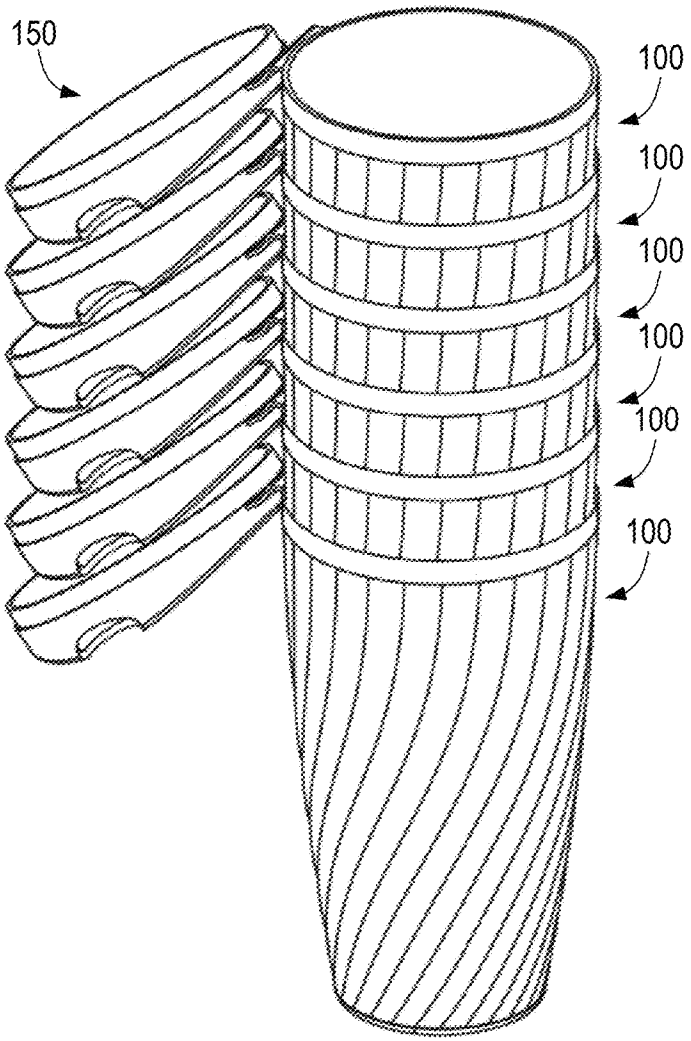
FIGS. 7-9 depict example disposable cups in stacked configurations in accordance with various non-limiting embodiments.
Figure 7:
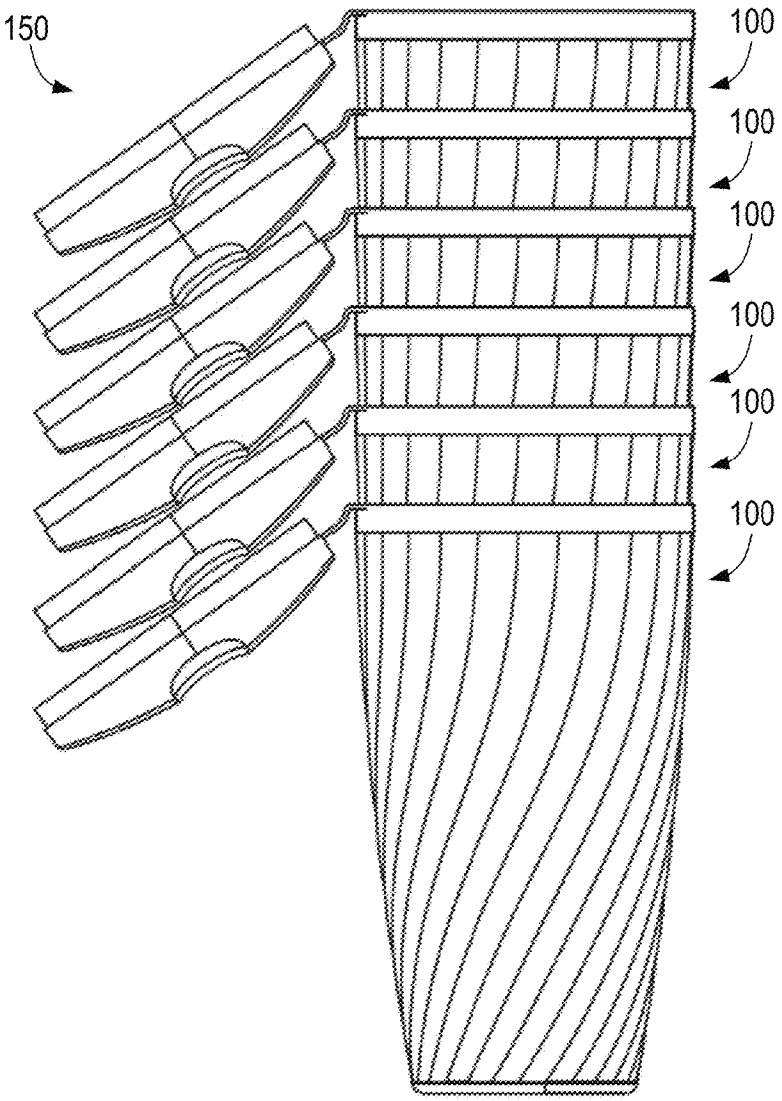
Figure 9:
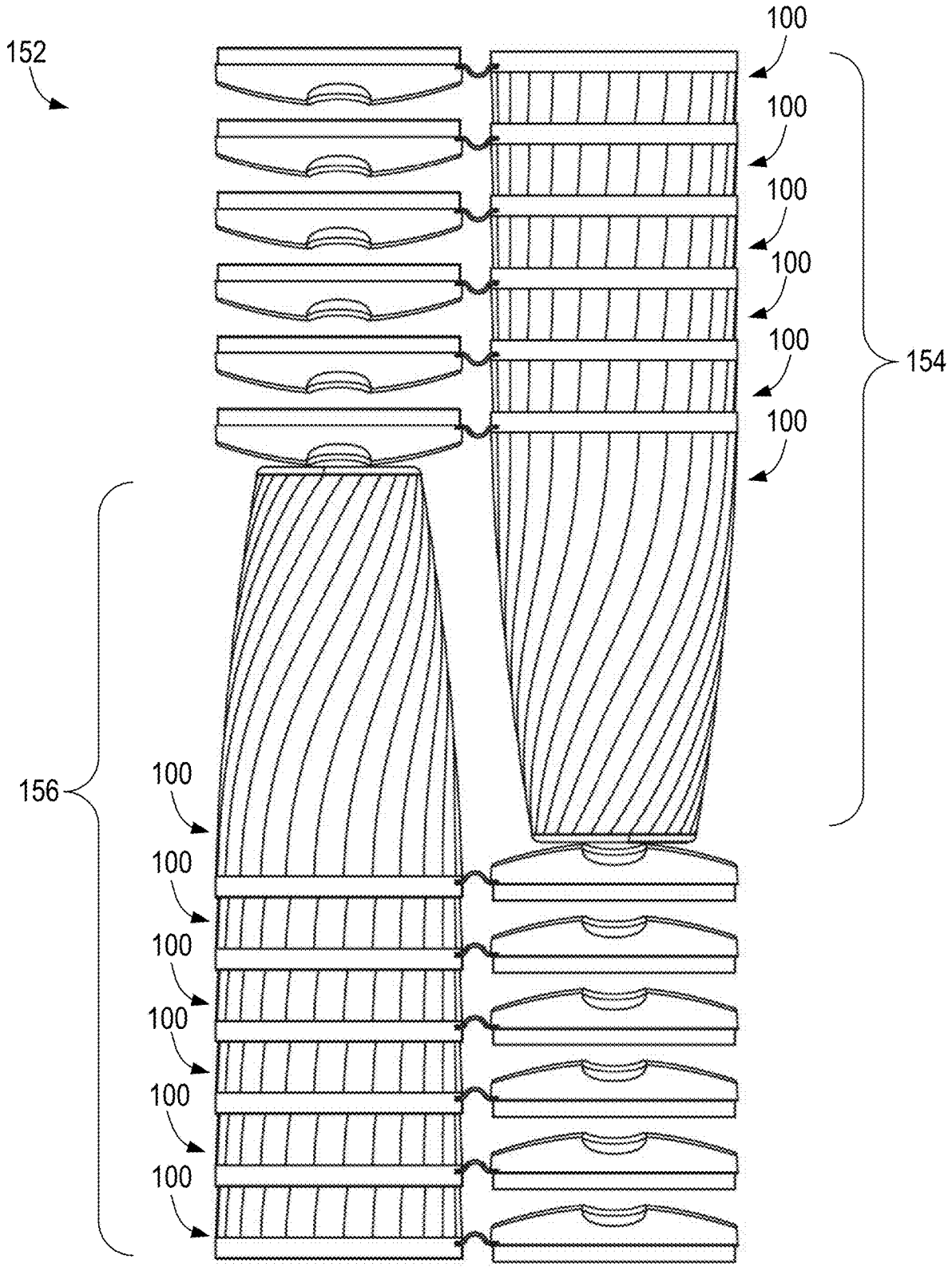

FIGS. 7-9 depict example disposable cups 100 in stacked configurations in accordance with various non-limiting embodiments. Such configuration can be used during shipment, storage, and dispensing, for example. The cup bodies are shown to have tapered cylindrical shapes which allow multiple disposable cups 100 to be nested into each other in a stacked configuration 150. As shown in FIG. 9, another stacked configuration 152 is shown for efficient shipping and storage options. For example, a first stack 154 of disposable cups 100 is shown positioned in an inverted position relative to a second stack 156 of disposable cups 100.

Figure 10:
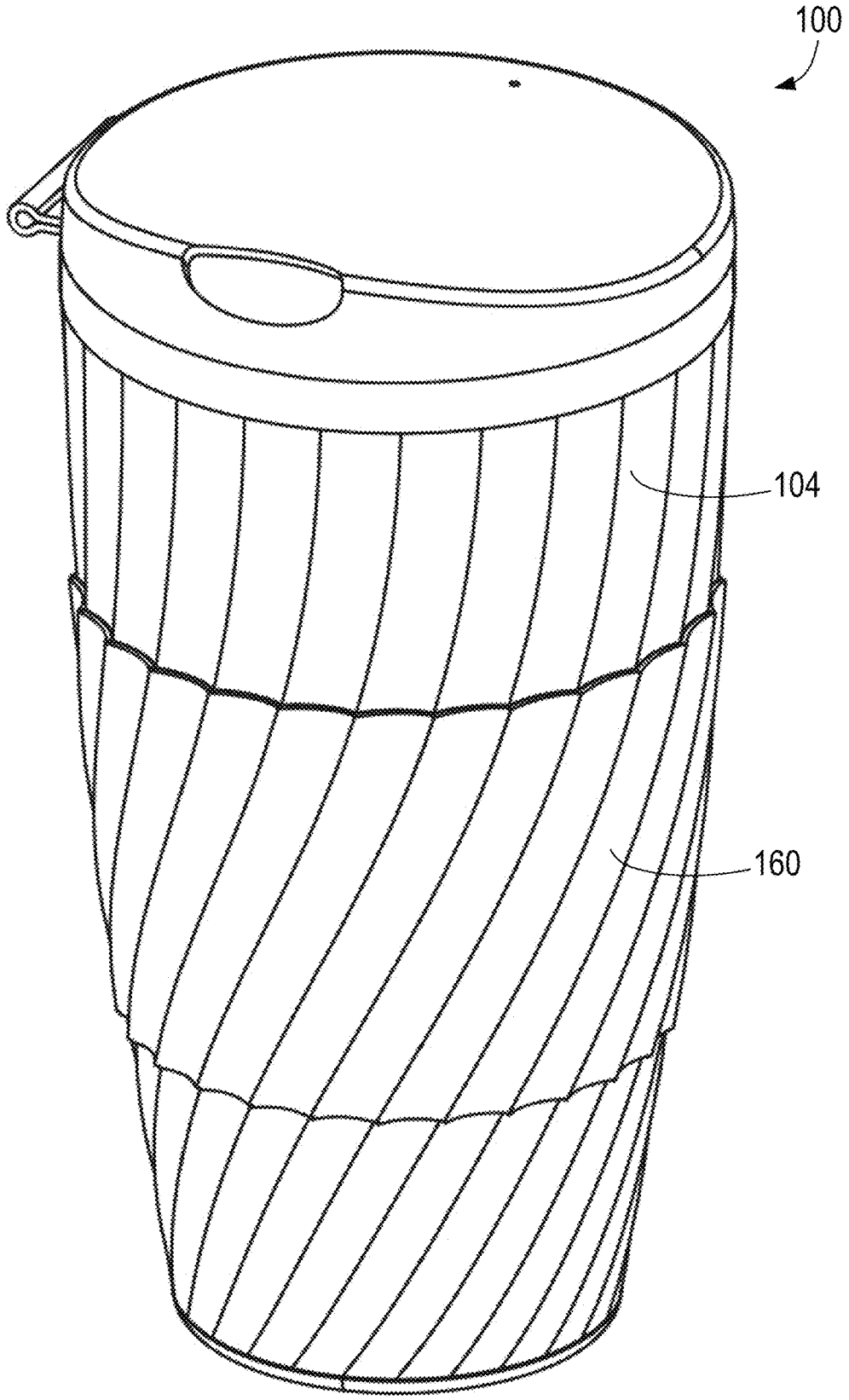
FIG. 10 depicts an example disposable cup with an integrated hinged lid and a integrated insulating band in accordance with one non-limiting embodiment.

FIG. 10 depicts the disposable cup 100 with an integrated insulating band 160 in accordance with one non-limiting embodiment. In some embodiments, the integrated insulating band 160 can be formed onto the disposable cup 100 at the time of manufacture such that the integrated insulating band 160 is unitary with the body portion 104. As is to be appreciated, the integrated insulating band 160 can be useful when the disposable cup 100 is used with hot beverages, such as coffee, tea, and the like. Further, integrated insulating bands similar to the integrated insulating band 160 can be incorporated into a variety of different embodiments, including the various embodiments described herein.

Figure 11A:
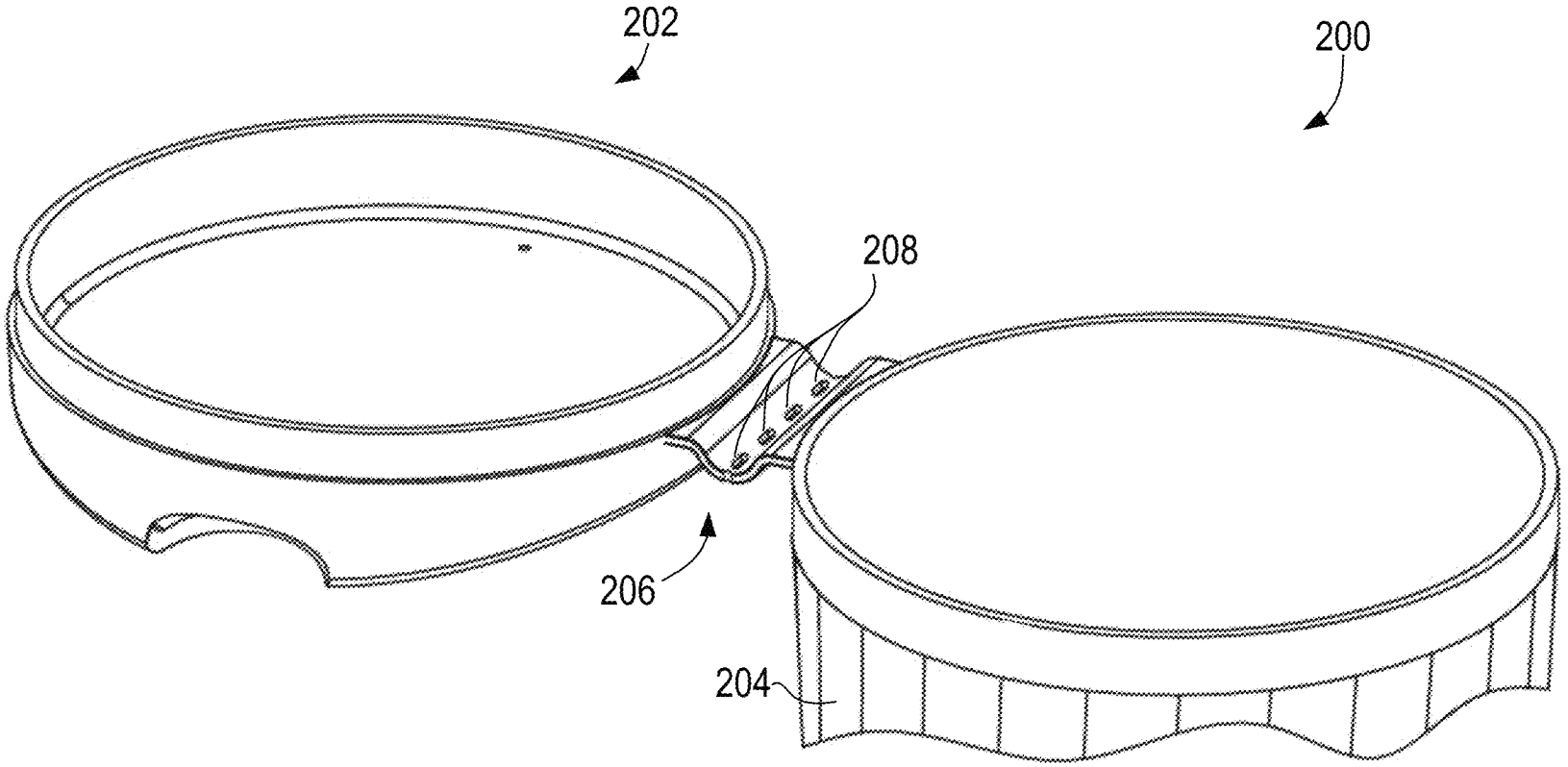
FIG. 11A depicts an example disposable cup with an integrated lid having a frangible hinge in accordance with one non-limiting embodiment.

FIG. 11A depicts an example disposable cup 200 with an integrated hinged lid 202 having a hinge 206 that is frangible in accordance with one non-limiting embodiment. The hinge 206 is designed with strategically engineered break points or perforations 208 in the material comprising the hinge. These perforations 208 allow for intentional separation of the hinged lid 202 from the body portion 204 by manually snapping the hinge 206 along the frangible break points with sufficient applied force. The perforations 208 remain strong enough, however, to keep the hinged lid 202 functionally attached to the body portion 204 during regular opening and closing of the lid, if desired.

Figure 11B:
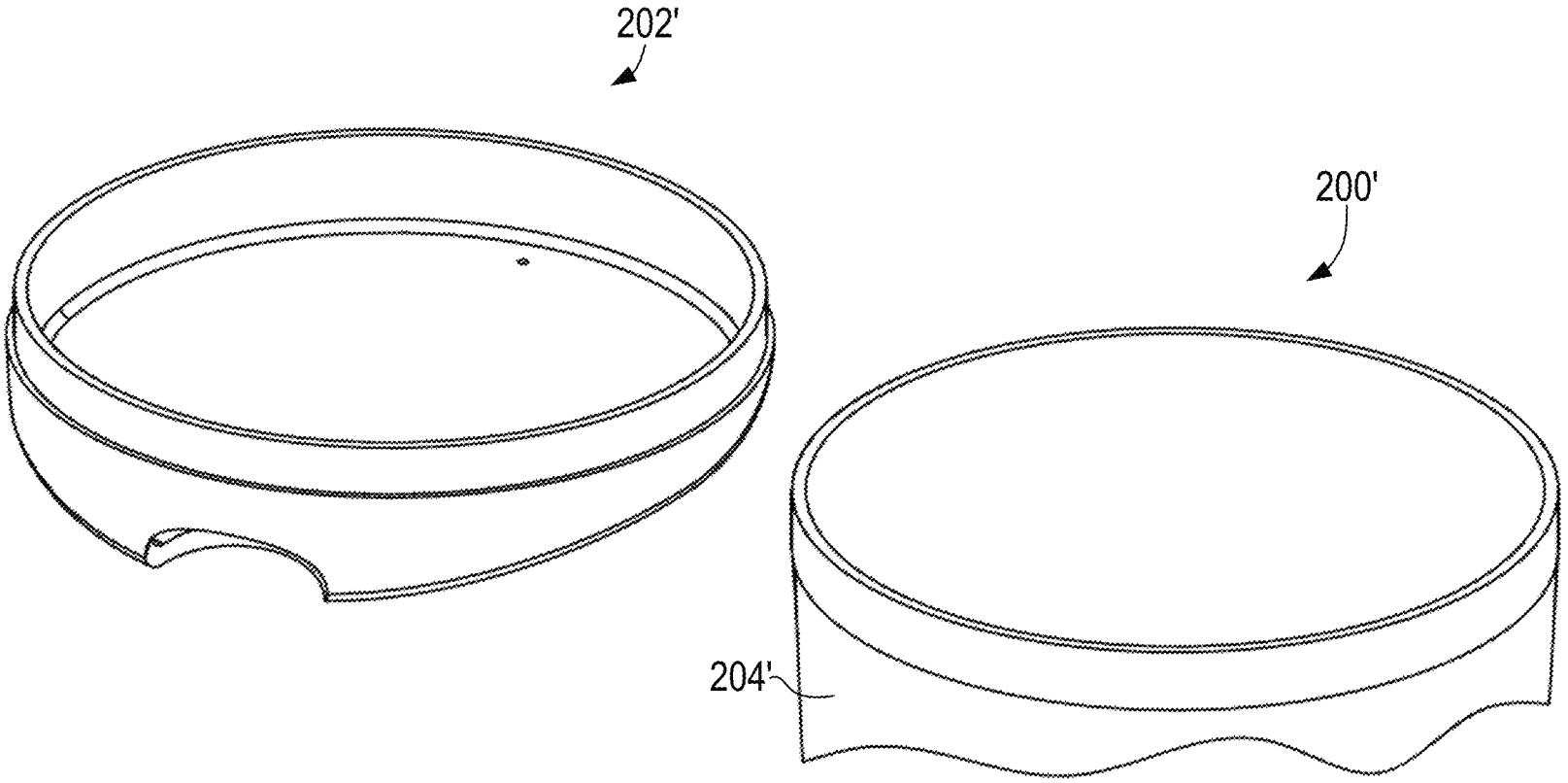
FIG. 11B depicts an example disposable cup with separate lid in accordance with one non-limiting embodiment.

While many of the embodiments described herein utilize a hinged lid, this disclosure is not so limited. In some embodiments, a single process recyclable cup and its associated lid can be manufactured separately, but from the same manufacturing material. In such embodiments, for example, the cup and lid can each be formed entirely from wood or fiber pulp-based material. FIG. 11B depicts one non-limiting example of such an embodiment. The disposable cup 200' and lid 202' are shown to be generally similar to the disposable cup 200 and hinged lid 202 of FIG. 11A. In this embodiment, however, the lid 202' is not coupled to a body portion 204' via a hinge. Nevertheless, the cup 200' and lid 202' can each be readily recyclable via a single recycling process. As is to be appreciated, other embodiments described herein can also be implemented without the use of a hinge coupling the lid to the cup, while still providing a fully recyclable product.

Figure 13:
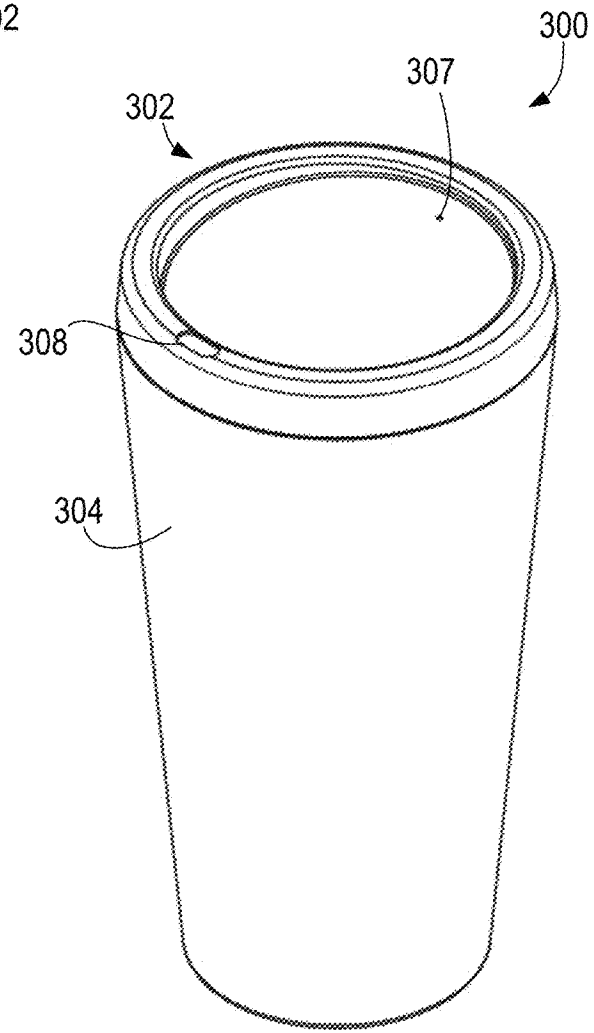
FIG. 13 depicts the disposable cup with an integrated hinged lid of FIG. 13 in a closed position in accordance with one non-limiting embodiment.
Figure 12:
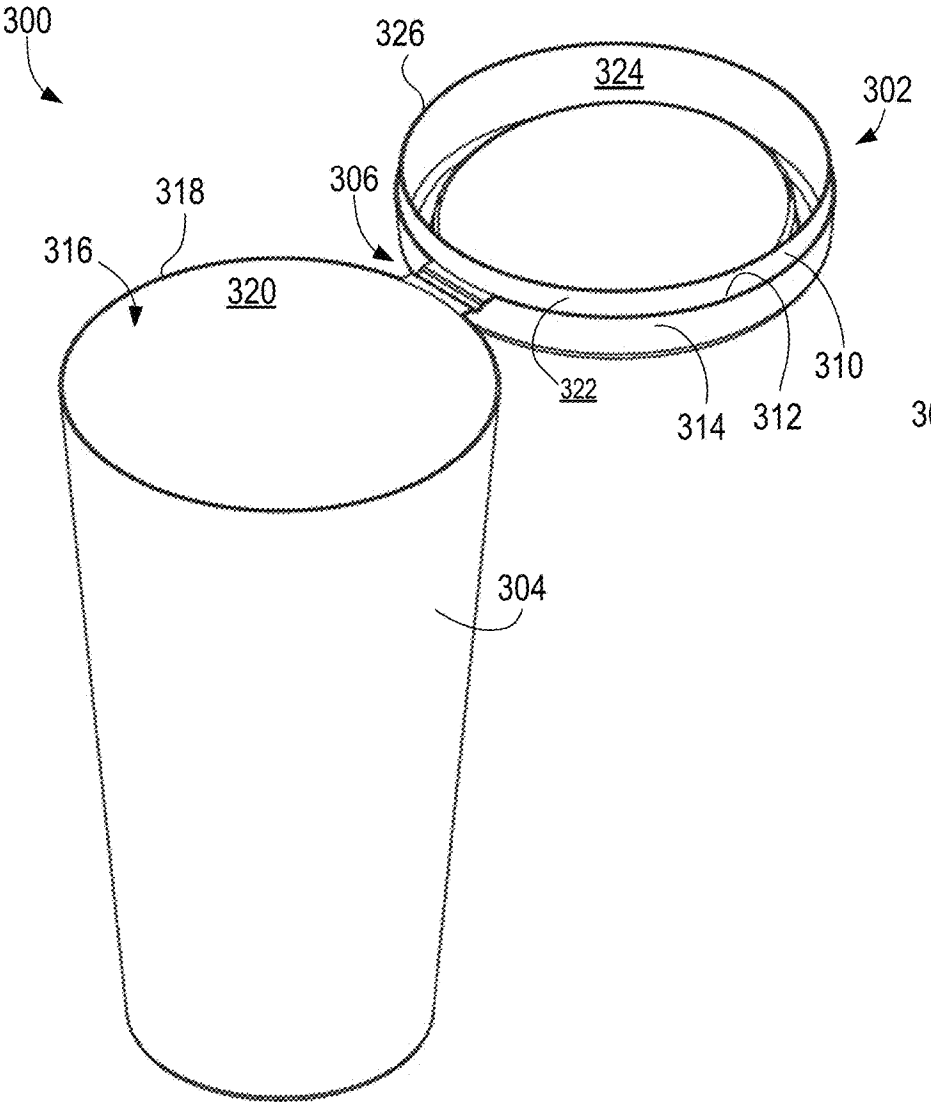
FIG. 12 depicts another example disposable cup with an integrated hinged lid in an open position in accordance with one non-limiting embodiment.
Figure 14:
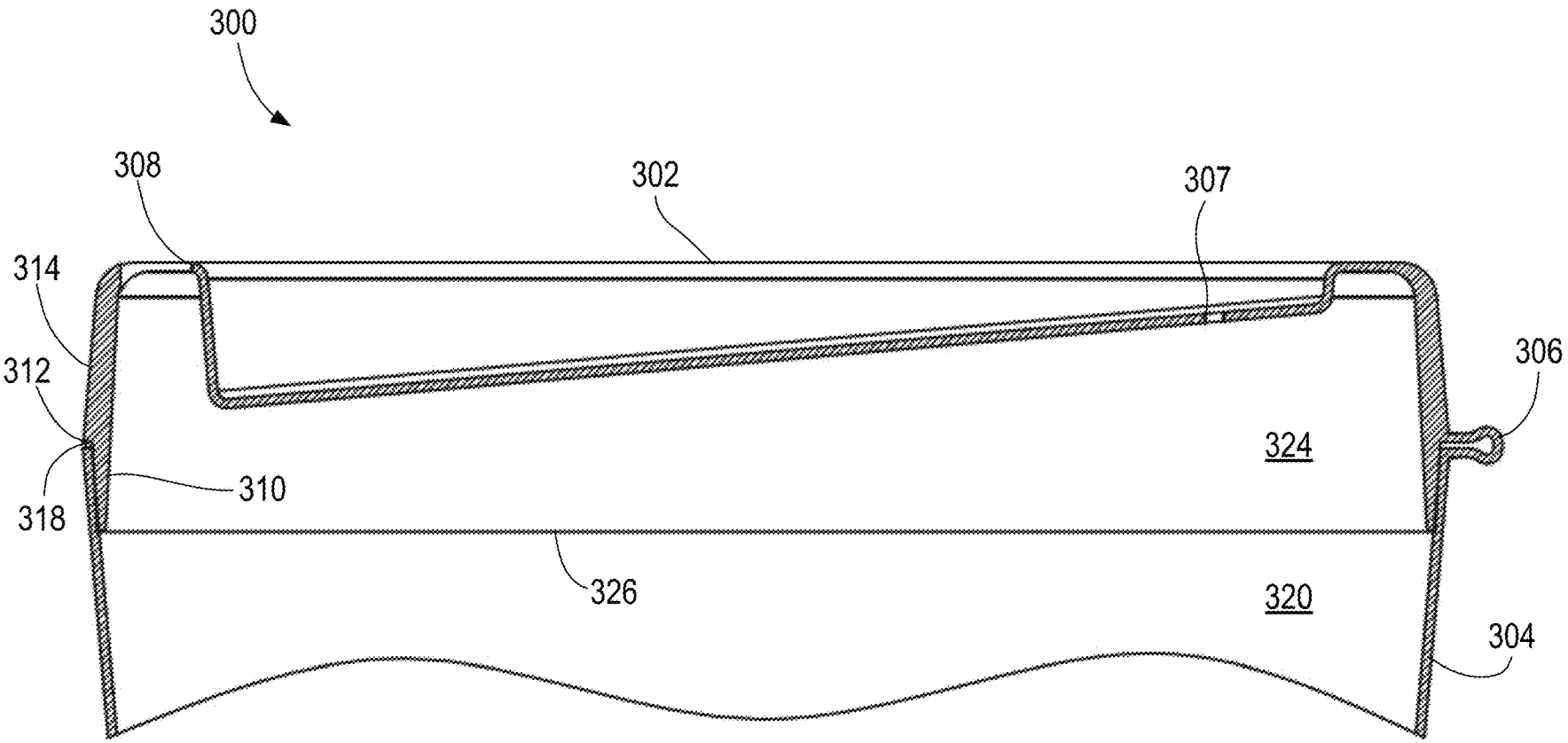
FIG. 14 is a cross-section view of the disposable cup with an integrated hinged lid of FIG. 14 taken through the hinge plane.
Figure 15:
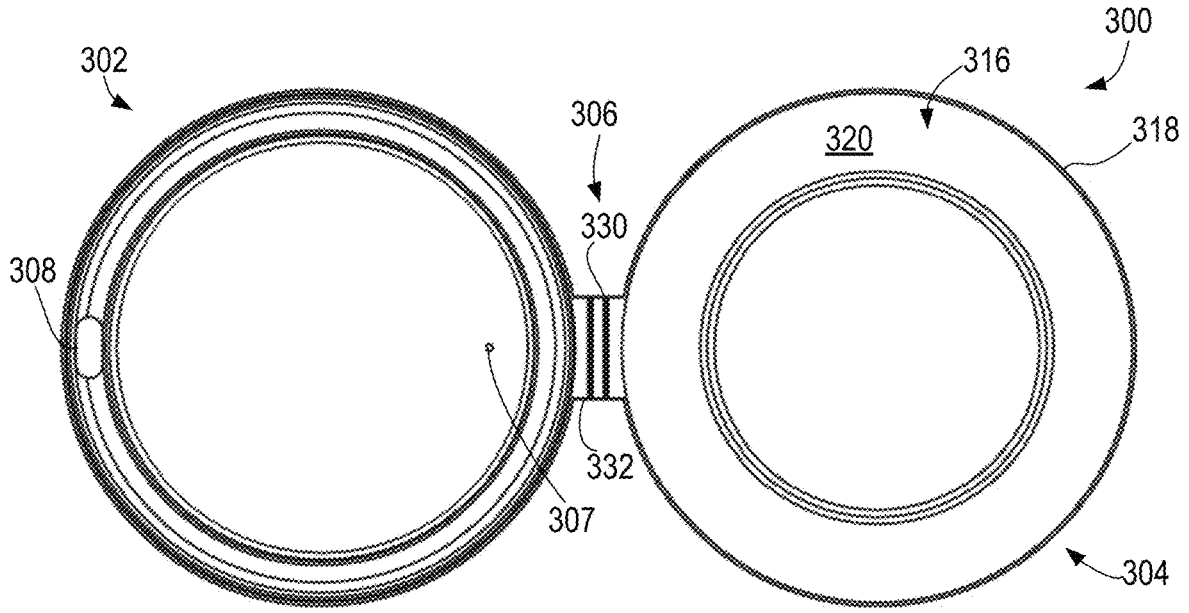
FIG. 15 depicts a top view of the example disposable cup with an integrated hinged lid of FIG. 12 in an open position in accordance with one non-limiting embodiment.

FIGS. 12-15 depict another example disposable cup 300 in accordance with one non-limiting embodiment. FIG. 12 depicts the disposable cup 300 with a hinged lid 302 in an open position while FIG. 13 depicts the hinged lid 302 in a closed position. FIG. 14 is a cross-section view of the disposable cup with an integrated hinged lid of FIG. 14 taken through the hinge plane. FIG. 15 depicts a top view of the disposable cup 300 in an open position.

The disposable cup 300 can include a body portion 304 having an inner surface 320. The inner surface 320 of the body portion 304 can define a cavity 316 that is fillable with liquid. The body portion 304 can be unlined and manufactured from a molded cellulosic material, for example. As shown, the body portion 304 can be smooth sided, although this disclosure is not so limited. The disposable cup 300 can include the hinged lid 302 that is coupled to the body portion 304 via a hinge 306. In some embodiments, the hinge 306 is a living hinge that joins the outer edge of the hinged lid 302 to the body portion 304. The hinge 306 can be an integrally molded component made from a thin, flexible molded cellulosic material that is formed to function as a pivoting joint between the body portion 304 and the hinged lid 302. More specifically, the hinge 306 can be formed during the molding manufacturing process, with the lid, hinge, and body portion comprising one continuous unitary product rather than separate components that are fastened together.

Figure 16:
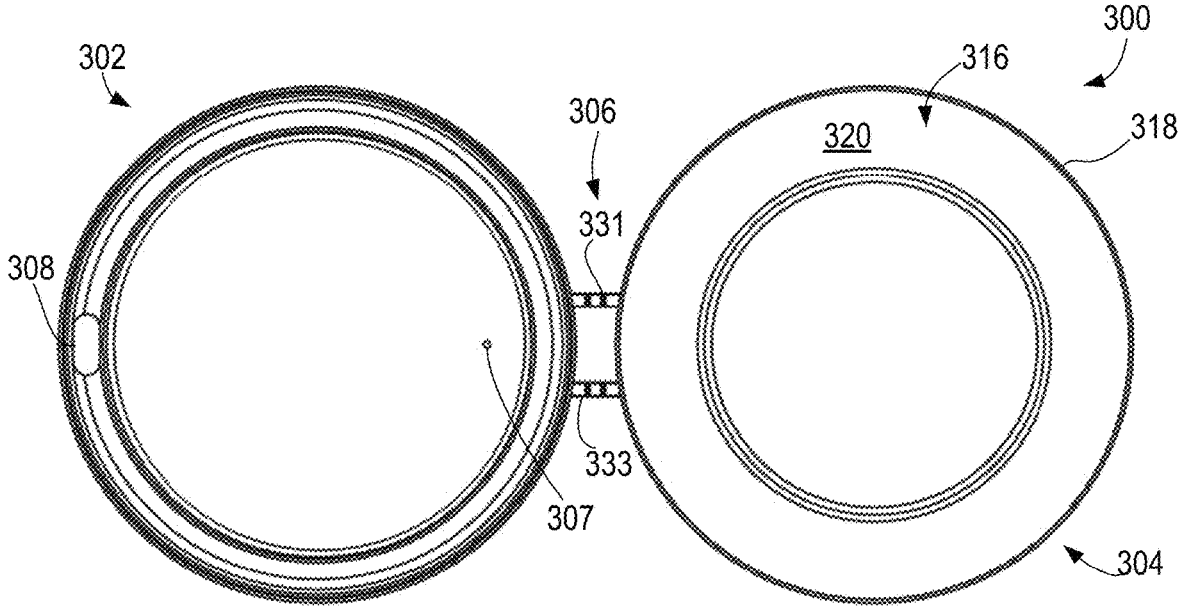
FIG. 16 depicts a top view of another example disposable cup with an integrated hinged lid in an open position in accordance with one non-limiting embodiment.

In some embodiments, the hinge 306 is generally planar with a first edge 330 and a second edge 332 extending between the body portion 304 and the hinged lid 302 in a parallel configuration (see FIG. 15). In other embodiments, however, the hinge 306 can have different configurations that allow for the functionality described herein. For example, FIG. 16 illustrates an example hinge 306 that includes two relatively thin connecting webs 331 and 333 that collectively form a pivoting joint between the body portion 304 and the hinged lid 302. In some embodiments, the connecting webs 331 and 333 are frangible, such that they can be selectably broken to completely separate the hinged lid 302 from the body portion 304. In any event, the hinge 306 can enable the hinged lid 302 to be repeatedly pivoted between an open and closed position while still retaining an attachment to the body portion 304.

Referring again to FIGS. 12-15, in some embodiments, the hinged lid 302 can include an upper portion 314 that defines a spout 308 and an air vent 307. A lower portion 310 of the hinged lid 302 can have a slightly smaller diameter than the upper portion 314, with the lower portion 310 and the upper portion 314 being separated by a shoulder 312 that surrounds the hinged lid 302.

As shown in FIG. 14, the shoulder 312 can have a width that is similar to the width of a rim 318 of the body portion 304. The hinge 306 can extend outwardly from the shoulder 312 and connect to the rim 318 of the body portion 304. In some embodiments, the lower portion 310 can have an inner surface 324 and an outer surface 322 that meet at a lid rim 326. When the hinged lid 302 is moved to a closed position, the lower portion 310 can be received into the body portion 304, such that the outer surface 322 of the hinged lid 302 is in frictional contact with the inner surface 320 of the body portion 304. The shoulder 312 of the hinged lid 302 can sit on the rim 318 of the body portion 304, such that a generally liquid tight seal is created between the hinged lid 302 and the body portion 304.

Figure 18:
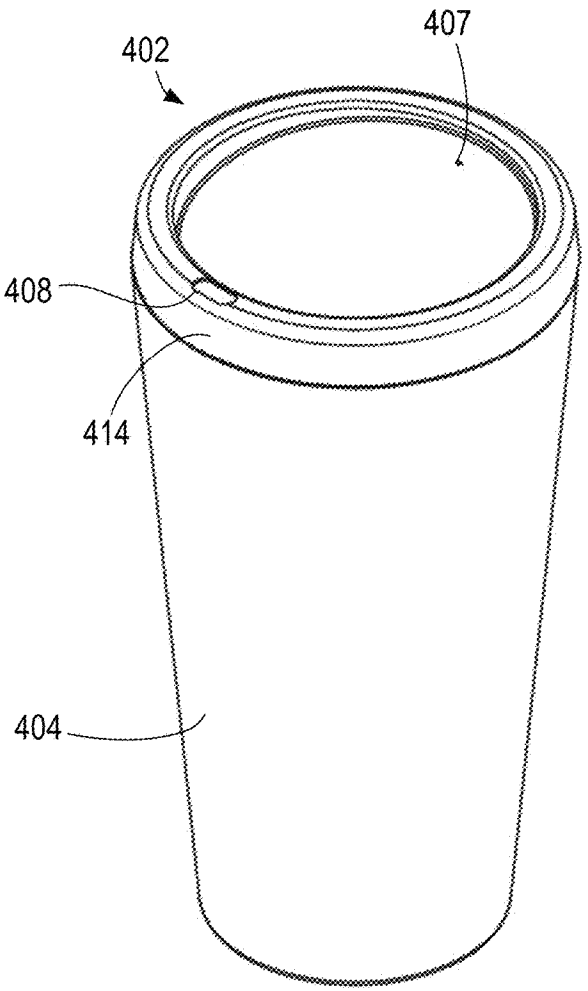
FIG. 18 depicts the disposable cup with an integrated hinged lid of FIG. 17 in a closed position in accordance with one non-limiting embodiment.
Figure 17:
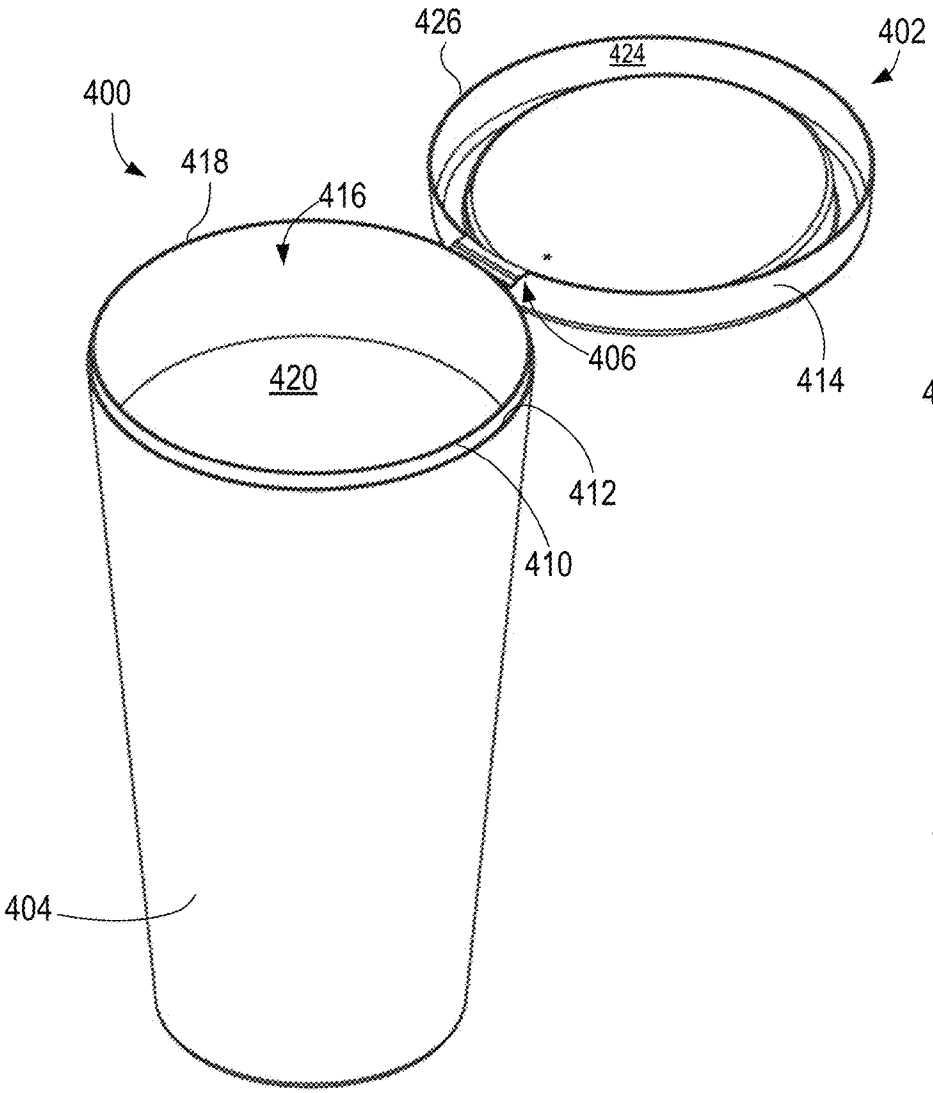
FIG. 17 depicts another example disposable cup with an integrated hinged lid in an open position in accordance with one non-limiting embodiment.
Figure 19:
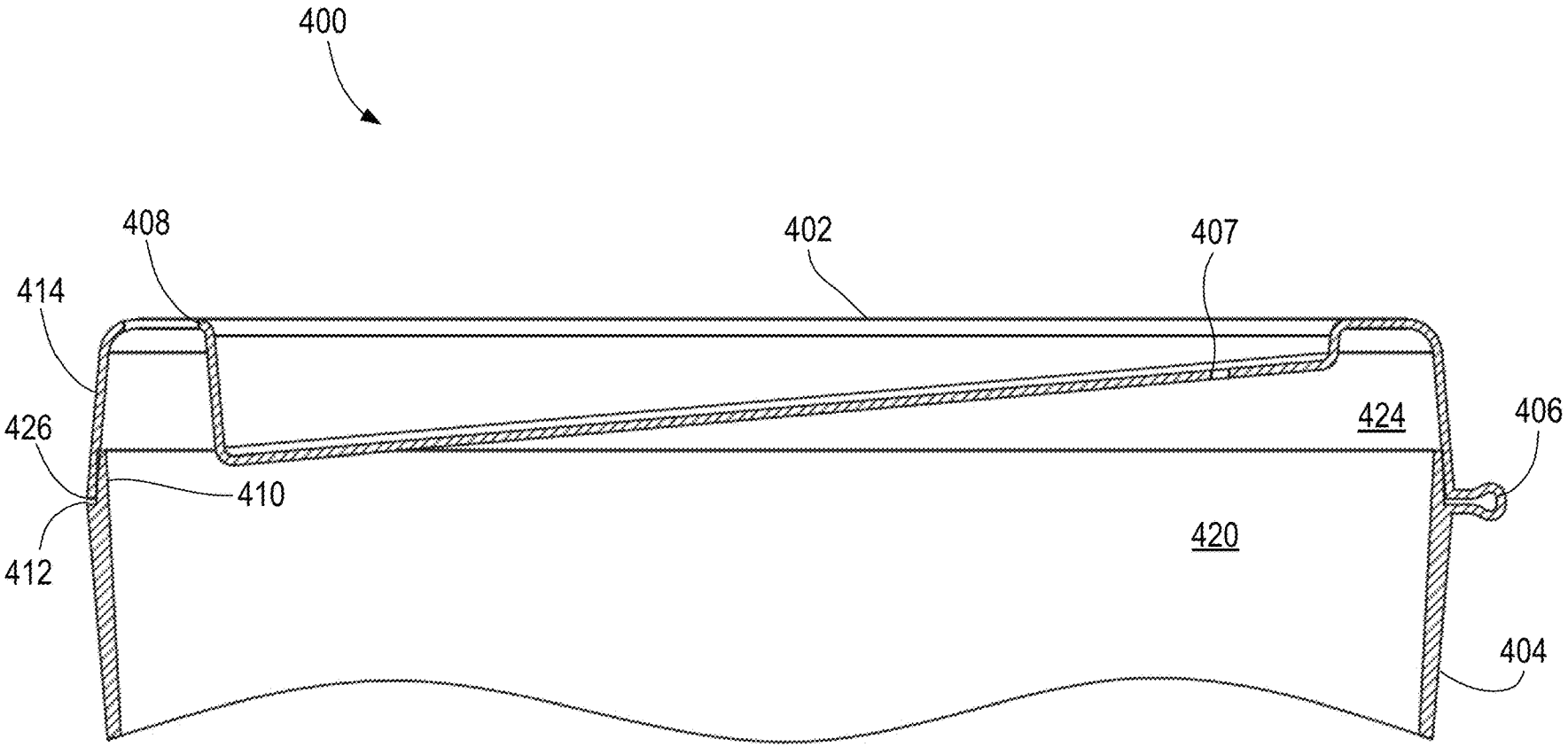
FIG. 19 is a cross-section view of the disposable cup with an integrated hinged lid of FIG. 18 taken through the hinge plane.

Referring now to FIGS. 17-19, another example disposable cup 400 is illustrated. FIG. 17 depicts the disposable cup 400 with a hinged lid 402 in an open position while FIG. 18 depicts the hinged lid 402 in a closed position. FIG. 19 is a cross-section view of the disposable cup with an integrated hinged lid of FIG. 18 taken through the hinge plane. The disposable cup 400 can include a body portion 404 having an inner surface 420. The inner surface 420 of the body portion 404 can define a cavity 416 that is fillable with liquid. The body portion 404 can be unlined and manufactured from a molded cellulosic material, for example.

The disposable cup 400 can include the hinged lid 402 that is coupled to the body portion 404 via a hinge 406. In some embodiments, the hinge 406 is a living hinge that joins the outer edge of the hinged lid 402 to the body portion 404. The hinge 406 can be an integrally molded component made from a thin, flexible molded cellulosic material that is formed to function as a pivoting joint between the body portion 404 and the hinged lid 402. More specifically, the hinge 406 can be a flexible web of material formed during the molding manufacturing process, with the lid, hinge, and body portion comprising one continuous unitary product rather than separate components that are fastened together. The hinge 406 can have different configurations that allow for the functionality described herein. In any event, the hinge 406 can enable the hinged lid 402 to be repeatedly pivoted between an open and closed position while still retaining an attachment to the body portion 404.

In some embodiments, the hinged lid 402 defines a spout 408 and an air vent 407. The body portion 404 can have an upper portion 410 that has a slightly smaller diameter that is positioned between a rim 418 of the body portion 404 and a shoulder 412. The shoulder 412 can have a width that is similar to the width of a lid rim 426, as shown in FIG. 19. The hinge 406 can extend outwardly from the shoulder 412 and connect to a flange portion 414 of the hinged lid 402. When the hinged lid 402 is moved to a closed position, the upper portion 410 of the body portion 404 can be received into the lower portion of the flange portion 414 of the hinged lid 402, such that an outer surface of the upper portion 410 and an inner surface 424 of the hinged lid 402 are in frictional contact. The lid rim 426 can sit on the shoulder 412 defined by the body portion 404, such that a generally liquid tight seal is created between the hinged lid 402 and the body portion 404 when the hinged lid 402 is in the closed position.

Figure 21:
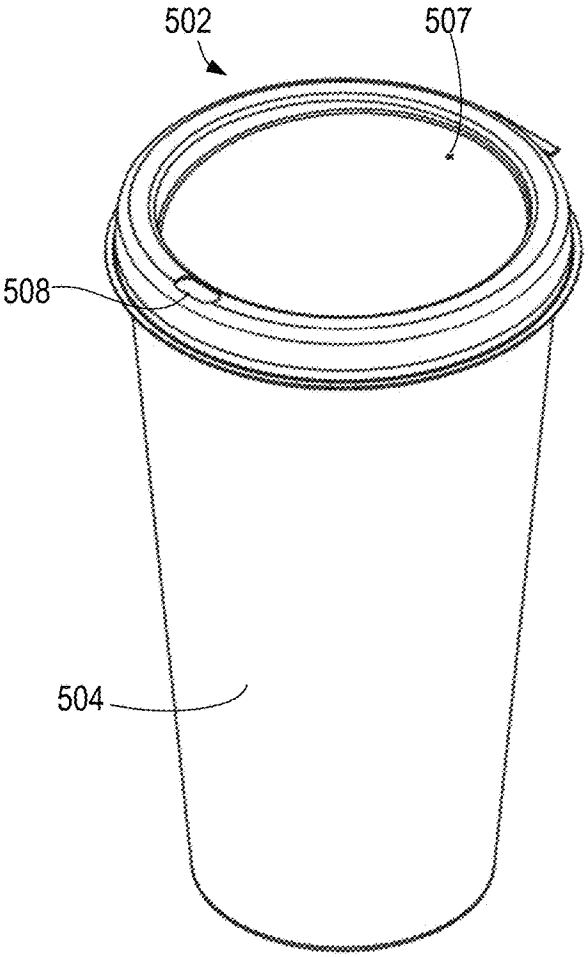
FIG. 21 depicts the disposable cup with an integrated hinged lid of FIG. 20 in a closed position in accordance with one non-limiting embodiment.
Figure 20:
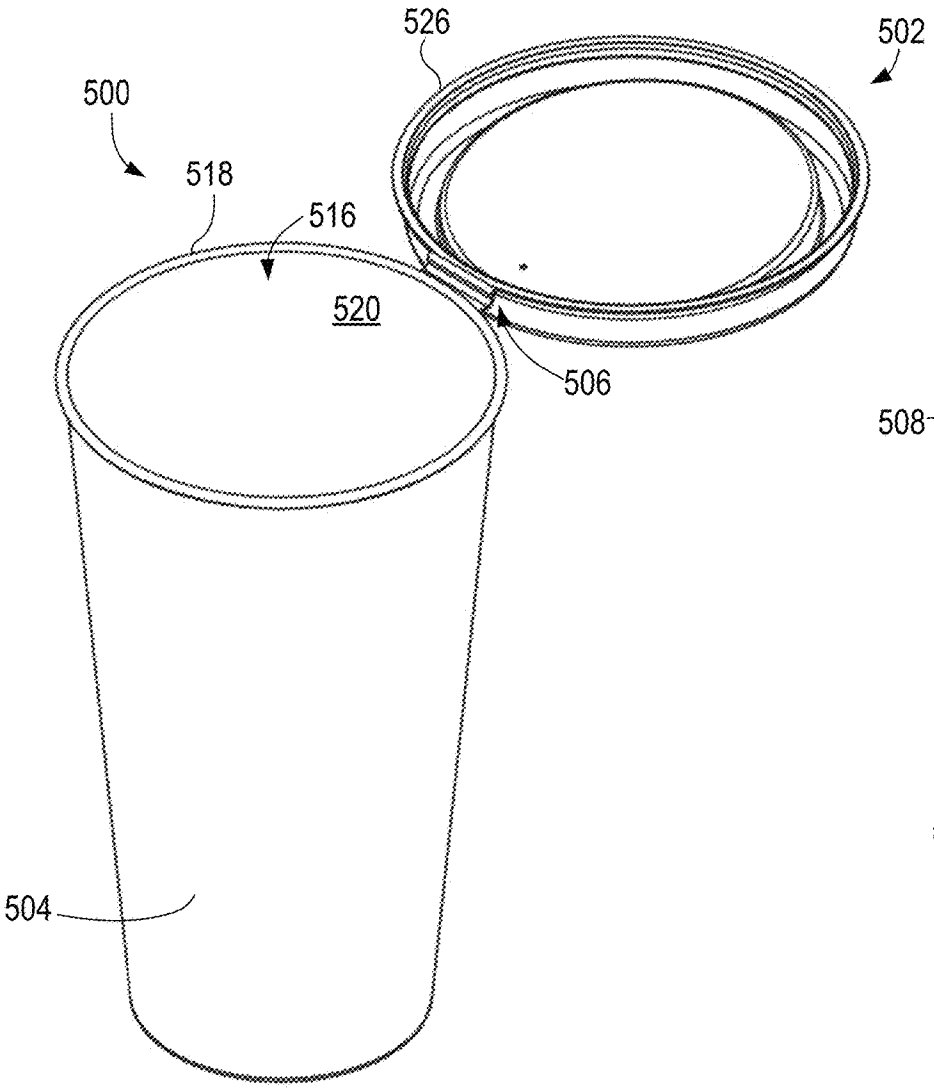
FIG. 20 depicts another example disposable cup with an integrated hinged lid in an open position in accordance with one non-limiting embodiment.
Figure 22:
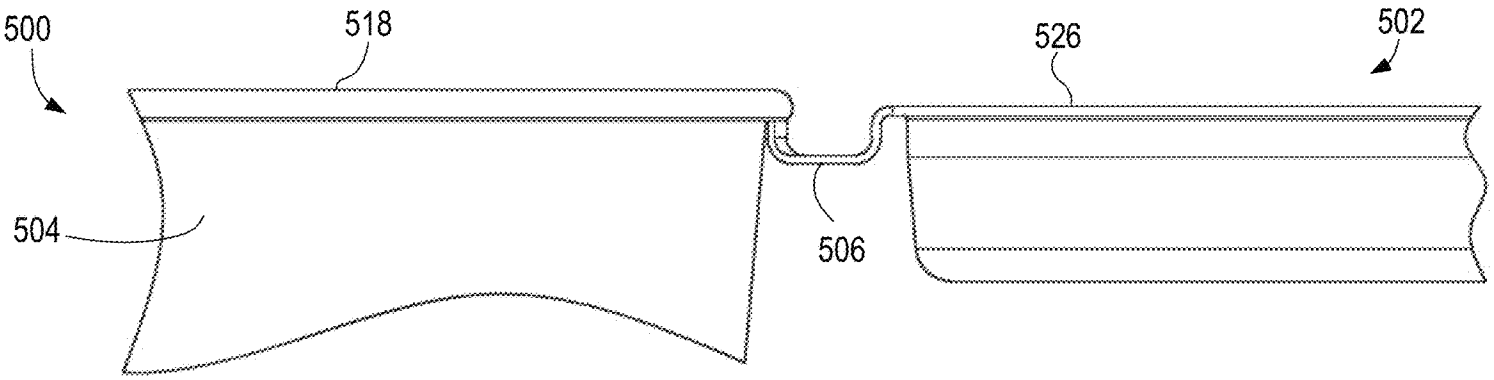
FIG. 22 is an enlarged view of the hinge of the disposable cup with an integrated hinged lid of FIG. 20 in accordance with one non-limiting embodiment.
Figure 23:
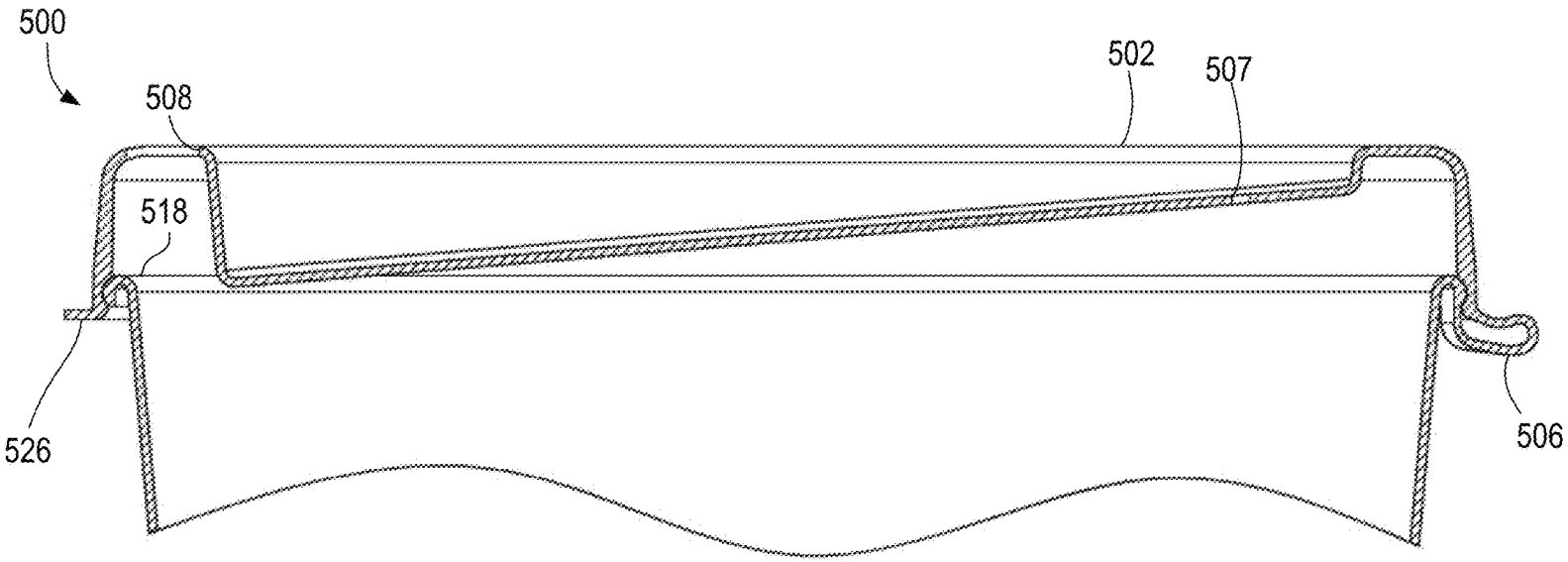
FIG. 23 is a cross-section view of the disposable cup with an integrated hinged lid of FIG. 21 taken through the hinge plane.

FIGS. 20-23 depict another example disposable cup 500 in accordance with another non-limiting embodiment. FIG. 20 depicts the disposable cup 500 with a hinged lid 502 in an open position while FIG. 21 depicts the hinged lid 502 in a closed position. FIG. 22 is an enlarged view of the hinge 506 of the disposable cup 500 while in an open position. FIG. 23 is a cross-section view of the disposable cup with an integrated hinged lid of FIG. 21 taken through the hinge plane.

The disposable cup 500 can include a body portion 504 having an inner surface 520. The inner surface 520 of the body portion 504 can define a cavity 516 that is fillable with liquid. The body portion 504 can be unlined and manufactured from a molded cellulosic material, for example. The disposable cup 500 can include the hinged lid 502 that is coupled to the body portion 504 via a hinge 506. In some embodiments, the hinge 506 is a living hinge that joins the outer edge of the hinged lid 502 to the body portion 504. The hinge 506 can be an integrally molded component made from a thin, flexible molded cellulosic material that is formed to function as a pivoting joint between the body portion 504 and the hinged lid 502. More specifically, the hinge 506 can be a flexible web of material formed during the molding manufacturing process, with the lid, hinge, and body portion comprising one continuous unitary product rather than separate components that are fastened together. The hinge 506 can have different configurations that allow for the functionality described herein. In any event, the hinge 506 can enable the hinged lid 502 to be repeatedly pivoted between an open and closed position while still retaining an attachment to the body portion 504.

In some embodiments, the hinged lid 502 defines a spout 508 and an air vent 507. The body portion 504 can have a rolled rim 518, which can be formed at the time of the body portion 504 is molded, for example. The hinge 506 can extend outwardly from the rolled rim 518 and connect to a flange 526 of the hinged lid 502. When the hinged lid 502 is moved to a closed position, the flange 526 can slightly radially splay outward to capture the rolled rim 518. The flange 526 and the rolled rim 518 can create a generally liquid tight seal between the hinged lid 502 and the body portion 504 when the hinged lid 502 is in the closed position.

Figure 24:
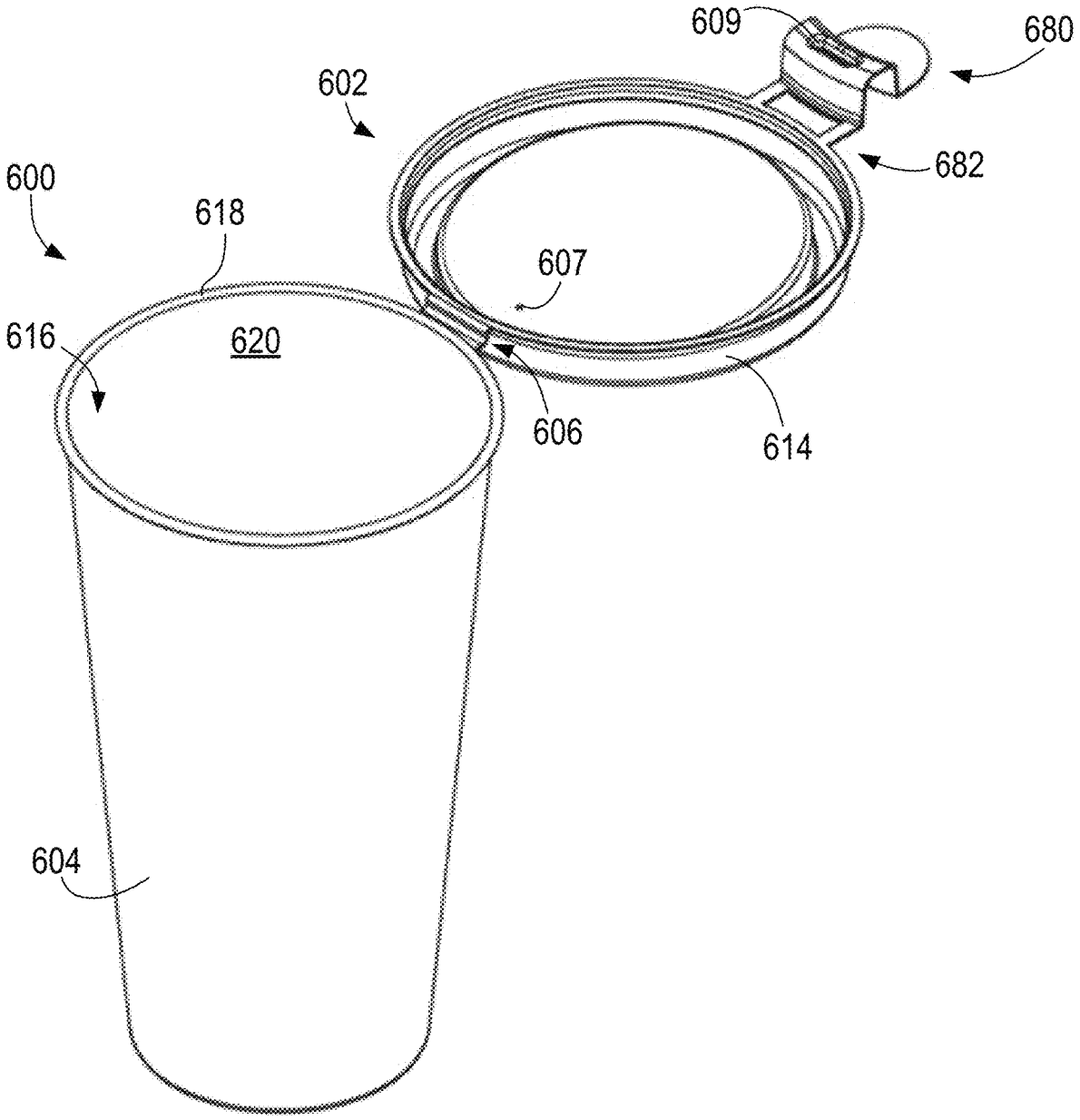
FIGS. 24-25 depict another example disposable cup with an integrated hinged lid having a hinged stopper, with the hinged lid in an open position in accordance with one non-limiting embodiment.
Figure 25:
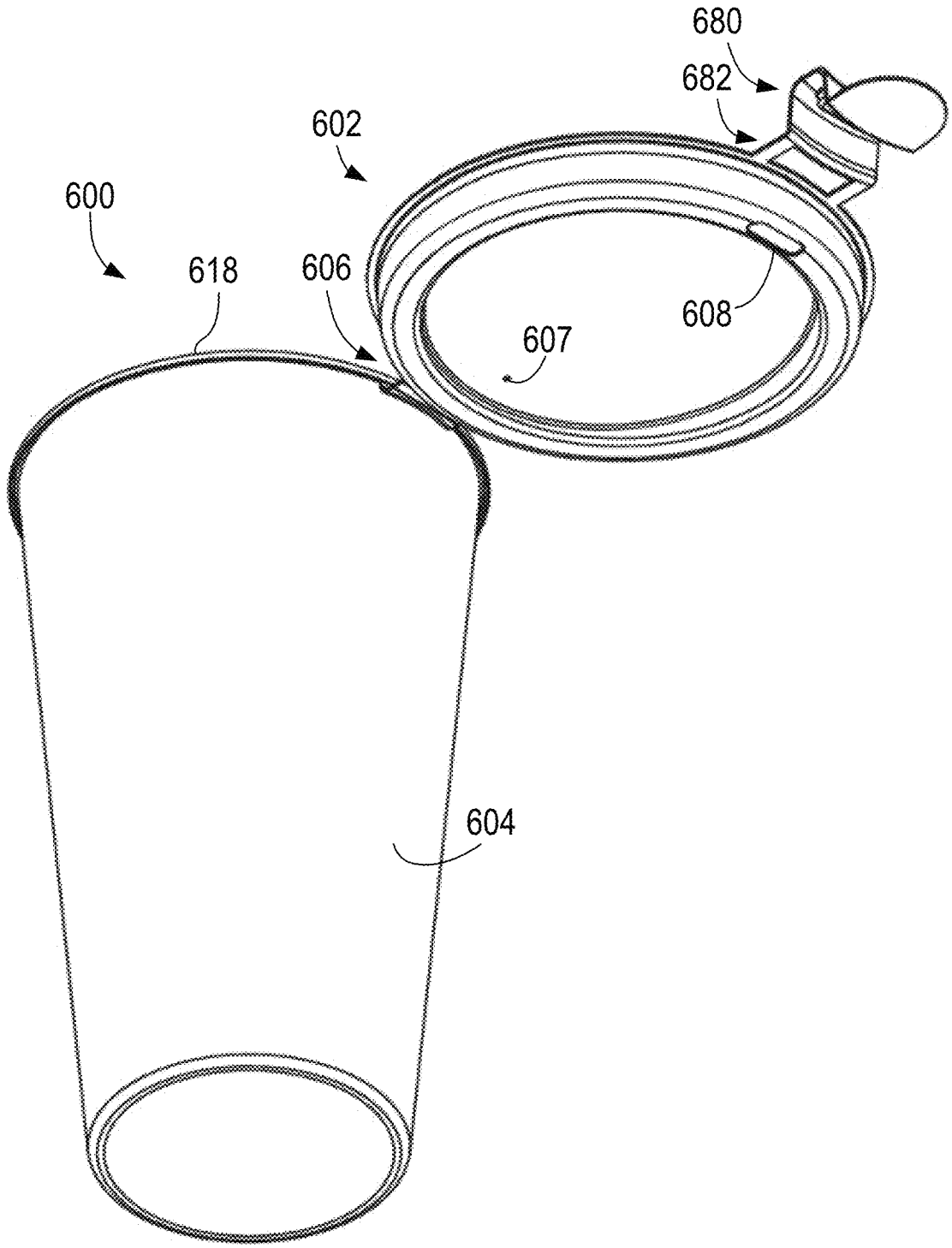
Figure 27:
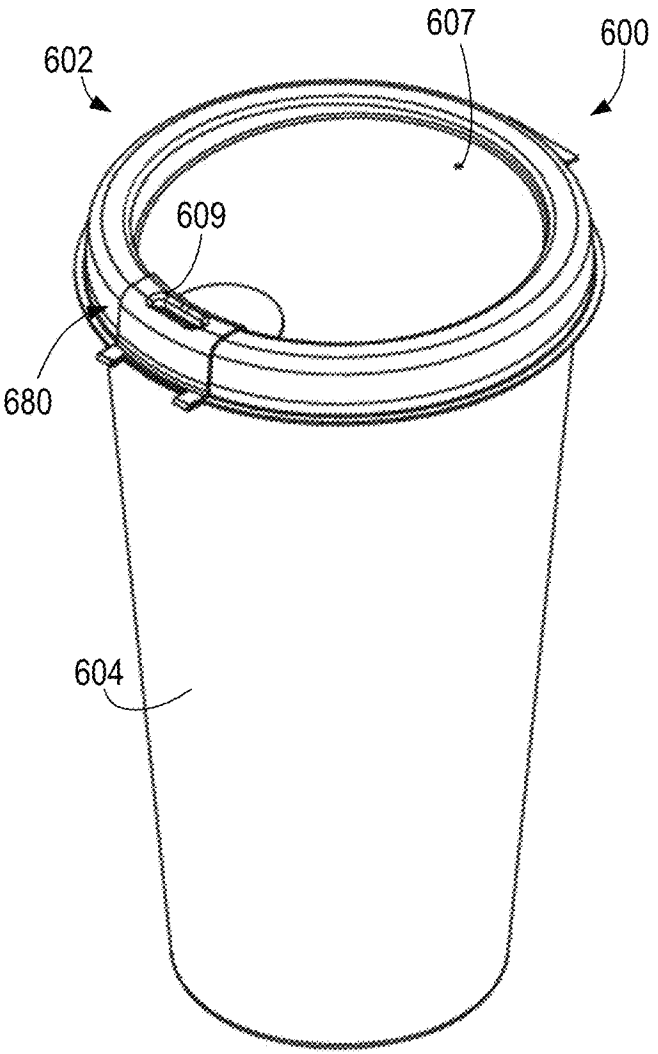
FIG. 27 depicts the disposable cup with an integrated hinged lid of FIG. 24 in a closed position with the hinged stopper in a closed position in accordance with one non-limiting embodiment.
Figure 26:
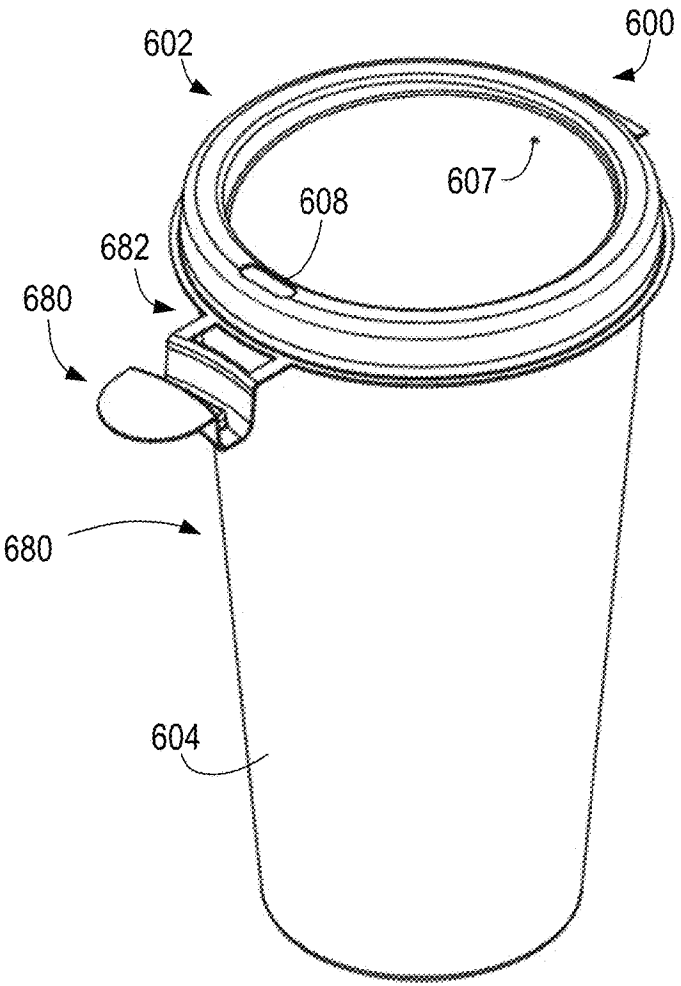
FIG. 26 depicts the disposable cup with an integrated hinged lid of FIG. 24 in a closed position with the hinged stopper in an open position in accordance with one non-limiting embodiment.
Figure 28:
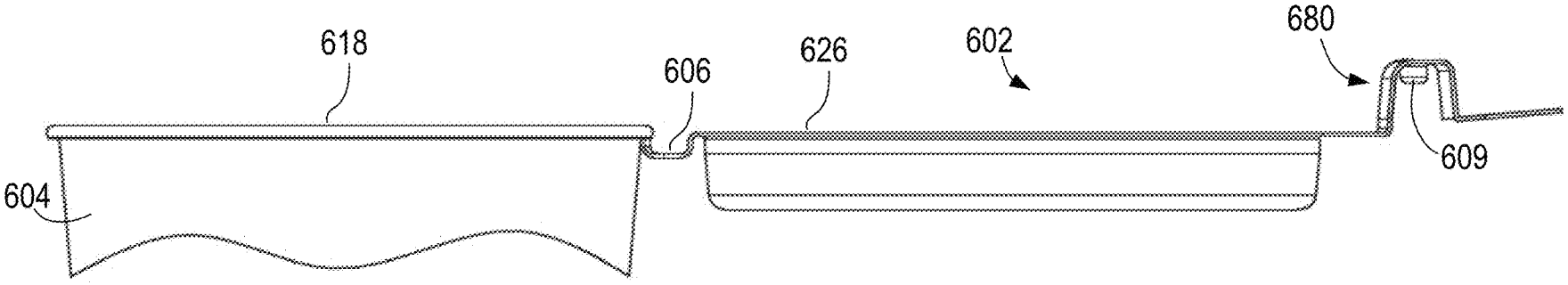
FIG. 28 is a view of the hinge of the disposable cup with an integrated hinged lid of FIG. 24 in accordance with one non-limiting embodiment.
Figure 29:
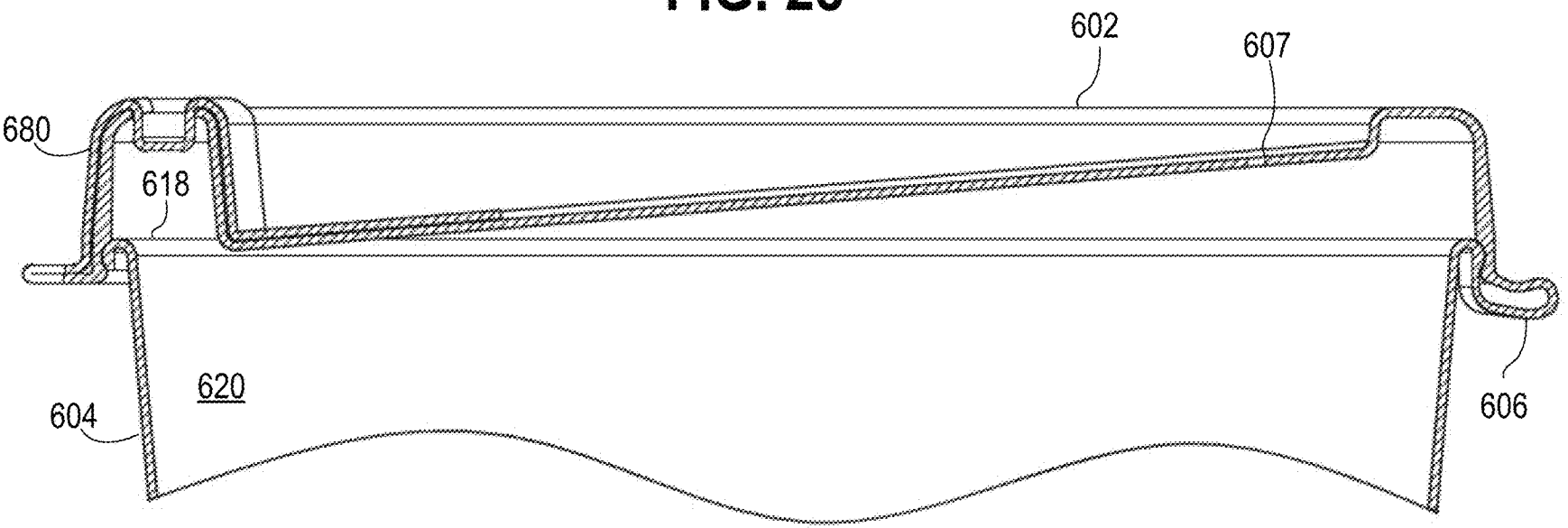
FIG. 29 is a cross-section view of the disposable cup with an integrated hinged lid of FIG. 27 taken through the hinge plane with the hinged stopper in the closed position.

FIGS. 24-29 depict another example disposable cup 600 having a hinged stopper in accordance with another non-limiting embodiment. FIGS. 24-25 depicts 600 with a hinged lid 602 having a hinged stopper 680, with the hinged lid 602 in an open position. FIG. 26 depicts the hinged lid 602 in a closed position with the hinged stopper 680 in an open position. FIG. 27 depicts the hinged lid 602 in a closed position with the hinged stopper 680 in a closed position. FIG. 28 is an enlarged view of the hinge 606 of the disposable cup 600 while in an open position. FIG. 29 is a cross-section view of the disposable cup with an integrated hinged lid of FIG. 27 taken through the hinge plane with the hinged stopper 680 in the closed position.

The disposable cup 600 can include a body portion 604 having an inner surface 620. The inner surface 620 of the body portion 604 can define a cavity 616 that is fillable with liquid. The body portion 604 can be unlined and manufactured from a molded cellulosic material, for example. The disposable cup 600 can include the hinged lid 602 that is coupled to the body portion 604 via a hinge 606. In some embodiments, the hinge 606 is a living hinge that joins the outer edge of the hinged lid 602 to the body portion 604. The hinge 606 can be an integrally molded component made from a thin, flexible molded cellulosic material that is formed to function as a pivoting joint between the body portion 604 and the hinged lid 602. More specifically, the hinge 606 can be a flexible web of material formed during the molding manufacturing process, with the lid, hinge, and body portion comprising one continuous unitary product rather than separate components that are fastened together. The hinge 606 can have different configurations that allow for the functionality described herein. In any event, the hinge 606 can enable the hinged lid 602 to be repeatedly pivoted between an open and closed position while still retaining an attachment to the body portion 604.

In some embodiments, the hinged lid 602 defines a spout 608 and an air vent 607. The body portion 604 can have a rolled rim 618. The hinge 606 can extend outwardly from the rolled rim 618 and connect to a flange 626 of the hinged lid 602. When the hinged lid 602 is moved to a closed position, the flange 626 can slightly radially splay outward to capture the rolled rim 618. The flange 626 and the rolled rim 618 can create a generally liquid tight seal between the hinged lid 602 and the body portion 604 when the hinged lid 602 is in the closed position.

In this embodiment, a hinged stopper 680 is movable between an open position (FIG. 26) and a closed position (FIG. 27) to close the drinking spout. A stopper hinge 682 can be an integrally molded component made from a thin, flexible molded cellulosic material that is formed to function as a pivoting joint between the hinged stopper 680 and the hinged lid 602. In some embodiments, the stopper hinge 682 can be frangible, such that the hinged stopper 680 can be selectably detached from the hinged lid 602 by a user. In some embodiments, a secondary operation can be utilized subsequent to the molding process that seeks to improve the functionality of the stopper hinge 682. For example, in some embodiments, the stopper hinge 682 can be scored, perforated, or otherwise augmented by a knife operation or other process. The hinged stopper 680 can also define a spout stopper 609 that generally aligns with and is received into the spout 608 of the hinged lid 602 when the hinged stopper 680 is in the closed configuration. Thus, while in the closed configuration, the spout stopper 609 is received into the spout 608 to seal the opening, as shown in FIG. 28.

Figure 30:
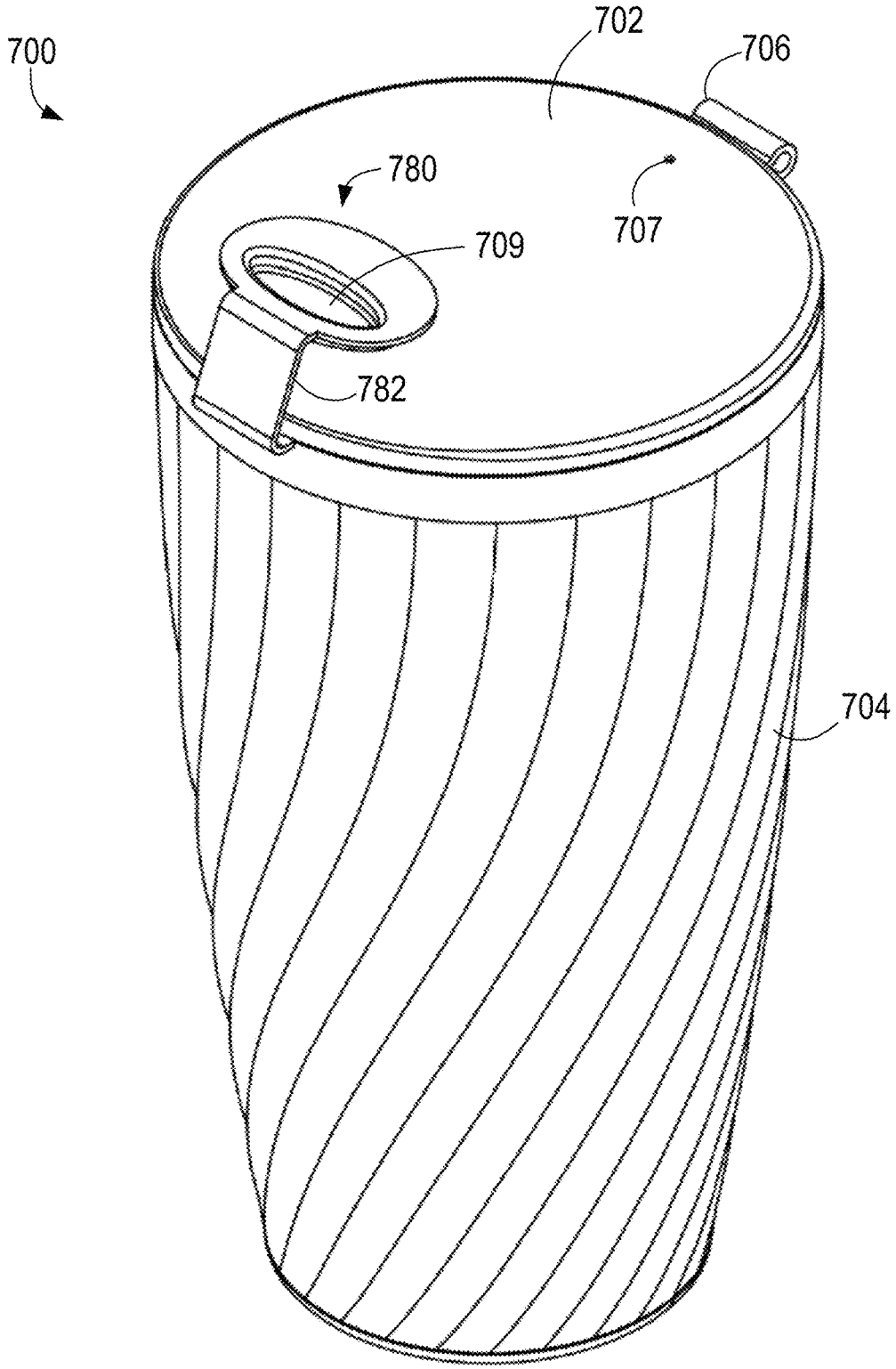
FIG. 30 depicts an example disposable cup with an integrated hinged lid having a hinged stopper, with the hinged lid and the hinged stopper in closed positions in accordance with one non-limiting embodiment.
Figure 31:
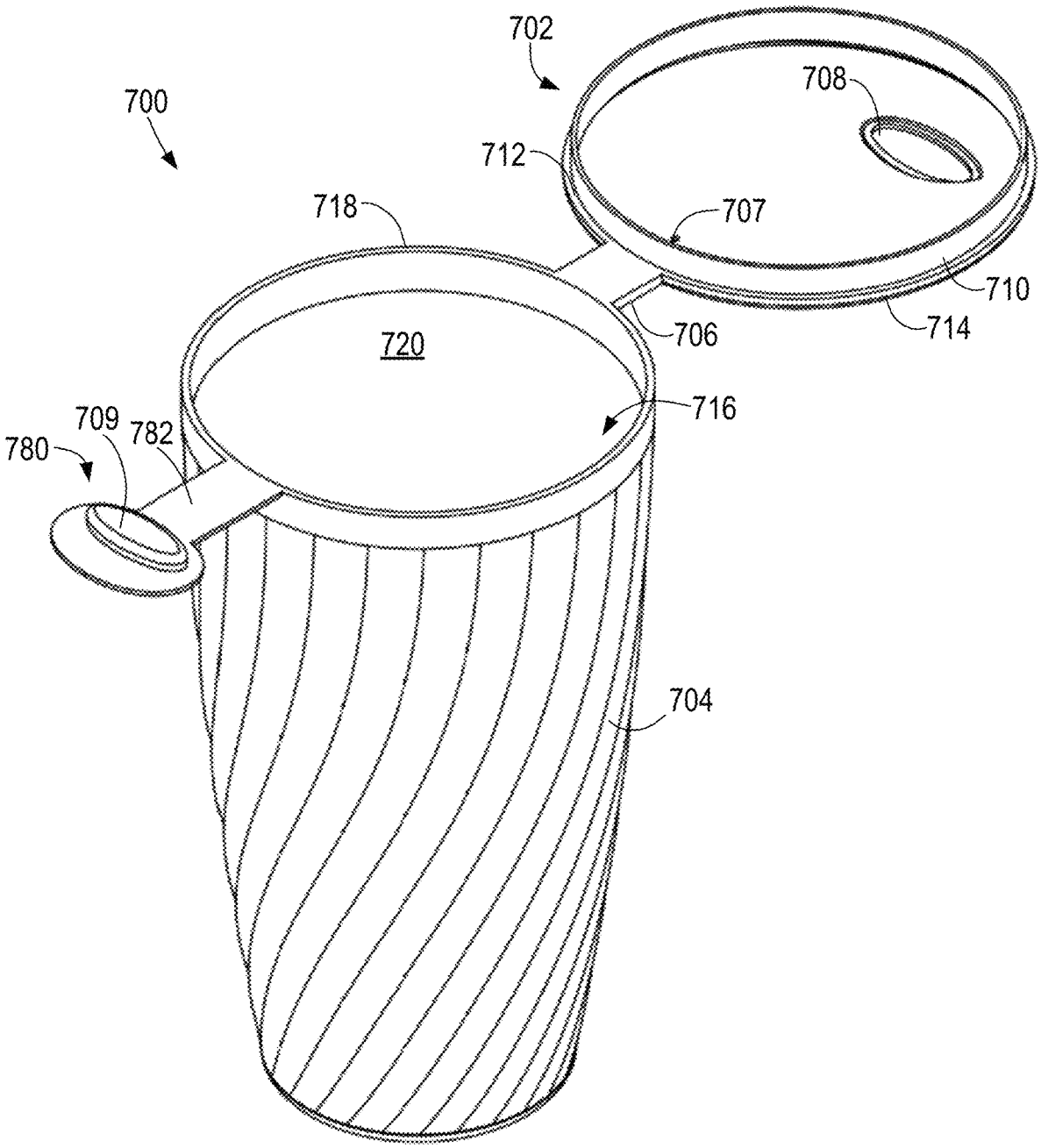
FIG. 31 depicts the disposable cup with an integrated hinged lid of FIG. 30 with the hinged lid in an open position in accordance with one non-limiting embodiment.
Figure 32:
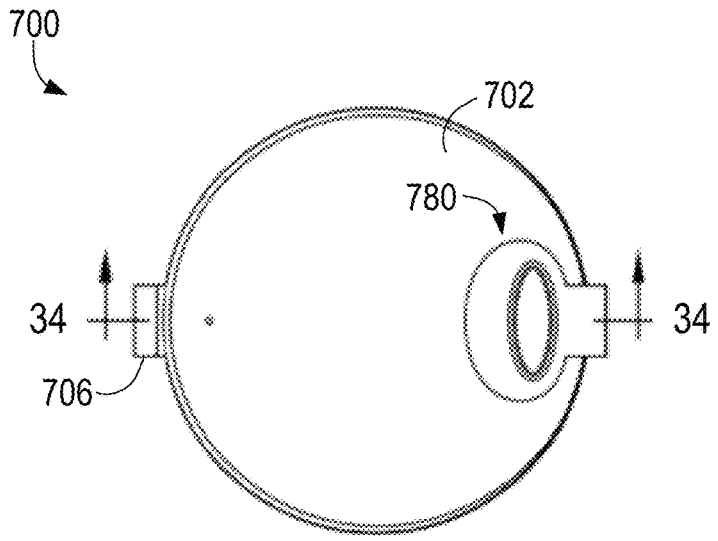
FIG. 32 depicts a top view of the example disposable cup with an integrated hinged lid of FIG. 30 in a closed position in accordance with one non-limiting embodiment.
Figure 33:
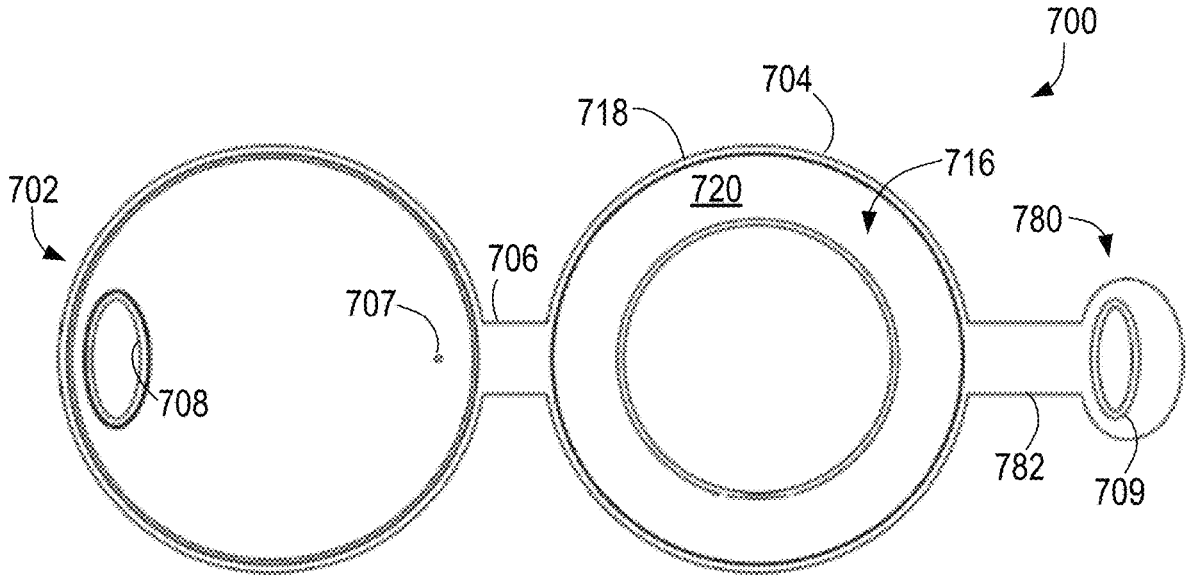
FIG. 33 depicts a top view of the example disposable cup with an integrated hinged lid of FIG. 30 in an open position in accordance with one non-limiting embodiment.
Figure 34:
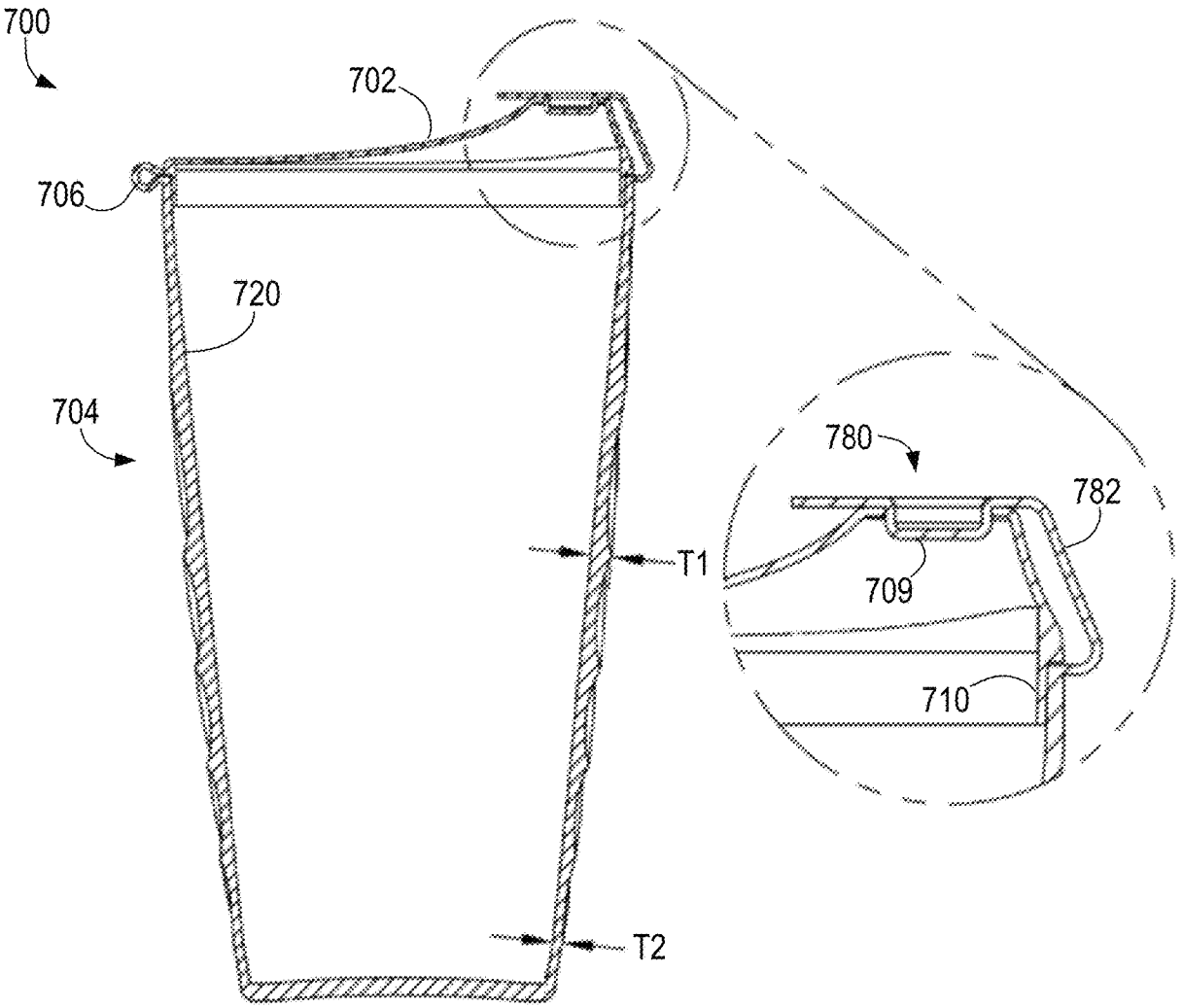
FIG. 34 is a cross-section view of the disposable cup with an integrated hinged lid of FIG. 32 taken through cross-section line 34-34.

FIGS. 30-34 depict another example disposable cup 700 having a hinged stopper 780 and an integrated hinged lid 702. FIG. 30 depicts the example disposable cup 700 with the hinged lid 702 and the hinged stopper 780 in closed positions. FIG. 31 depicts the disposable cup 700 with the integrated hinged lid 702 in an open position. FIG. 32 depicts a top view of the disposable cup 700 with the hinged lid 702 in the closed position and the hinged stopper 780 in the closed position. FIG. 33 depicts a top view of the disposable cup 700 with the hinged lid 702 in the open position. FIG. 34 is a cross-section view of the disposable cup 700 of FIG. 32 taken through cross-section line 34-34.

Referring to FIGS. 30-34, the disposable cup 700 can include a body portion 704 having an inner surface 720. The inner surface 720 of the body portion 704 can define a cavity 716 that is fillable with liquid. The body portion 704 can be unlined and manufactured from a molded cellulosic material, for example. The disposable cup 700 can include the hinged lid 702 that is coupled to the body portion 704 via a hinge 706. In some embodiments, the hinge 706 is a living hinge that joins the outer edge of the hinged lid 702 to the body portion 704. The hinge 706 can be an integrally molded component made from a thin, flexible molded cellulosic material that is formed to function as a pivoting joint between the body portion 704 and the hinged lid 702. More specifically, the hinge 706 can be a flexible web of material formed during the molding manufacturing process, with the lid, hinge, and body portion comprising one continuous unitary product rather than separate components that are fastened together. The hinge 706 can have different configurations that allow for the functionality described herein. In any event, the hinge 706 can enable the hinged lid 702 to be repeatedly pivoted between an open and closed position while still retaining an attachment to the body portion 704. Similar to the other hinges described herein, the hinge 706 can be scored, perforated, or otherwise augmented by a knife operation or other process to improve its flexibility.

In some embodiments, the hinged lid 702 defines a spout 708 and an air vent 707. A lower portion 710 of the hinged lid 702 can have a slightly smaller diameter than an upper portion 714, with the lower portion 710 and the upper portion 714 being separated by a shoulder 712 that surrounds the hinged lid 702. The shoulder 712 can have a width that is similar to the width of a rim 718 of the body portion 704. The hinge 706 can extend outwardly from the shoulder 712, as shown in FIG. 31.

In this embodiment, the hinged stopper 780 is movable between a closed position (FIG. 30) and an open position (FIG. 31) to selectively close the drinking spout 708. A stopper hinge 782 can be an integrally molded component made from a thin, flexible molded cellulosic material that is formed to function as a pivoting joint between the hinged stopper 780 and the body portion 704. The stopper hinge 782 can extend outwardly from the rim 718, as shown in FIG. 31. In some embodiments, the stopper hinge 782 can be frangible, such that the hinged stopper 780 can be selectably detached from the body portion 704 by a user. The hinged stopper 780 can also define a spout stopper 709 that generally aligns with and is received into the spout 708 of the hinged lid 702 when the hinged stopper 780 is in the closed configuration. Thus, while in the closed configuration, the spout stopper 709 is received into the spout 708 to seal the opening, as shown in FIGS. 30, 32, and 34.

In some embodiments, the external surface of the body portion 704 can be designed with various three-dimensional protrusions to enhance functionality and/or aesthetics. These features may include ribs (horizontal, vertical, or slanted, for example), flutes, or other types of protrusions that create varying thicknesses around the body portion 704. While the illustrations in FIGS. 30-34 depict spiral flutes, this disclosure is not so limited. An example variation in thickness is depicted in FIG. 34, where the spiral flutes result in alternating thicker and thinner sections of the body portion 704. In some embodiments, the thickness at T1 (i.e., thicker sections) can range from about ⅛ inches to about ¼ inches, while the thickness at T2 (i.e., thinner sections) can range from about 1/64 inches to about 1/16 inches. In one non-limiting implementation, T1 measures about 3/16 inch while T2 is about 1/32 inch. This significant difference in thickness with the thicker portion being six times the thickness of the thinner portion in this example allows for a balance between structural integrity, thermal performance, and tactile experience. In other embodiments, different thickness proportions can be used, such as the thicker portion being about 2 to 8 times thicker than the thinner portion. In any event, these measurements can allow for control over the thermal properties of the disposable cup 700 as well as the overall feel in the hand.

The placement and dimensions of the 3D protrusions can be configured to influence how users interact with the cup. For instance, the spacing and depth of the flutes (or alternative protrusions) can be designed so that when a person grips the body portion 704, their hand primarily only contacts the thicker sections. This design can enhance comfort and potentially improve heat insulation where the user's hand meets the cup. Additionally, some types of 3D features can create small air gaps between parts of the outer surface of the body portion 704 and the user's hand. This design can provide a more comfortable handling experience by reducing direct heat transfer to the user's hand.

Figure 35:
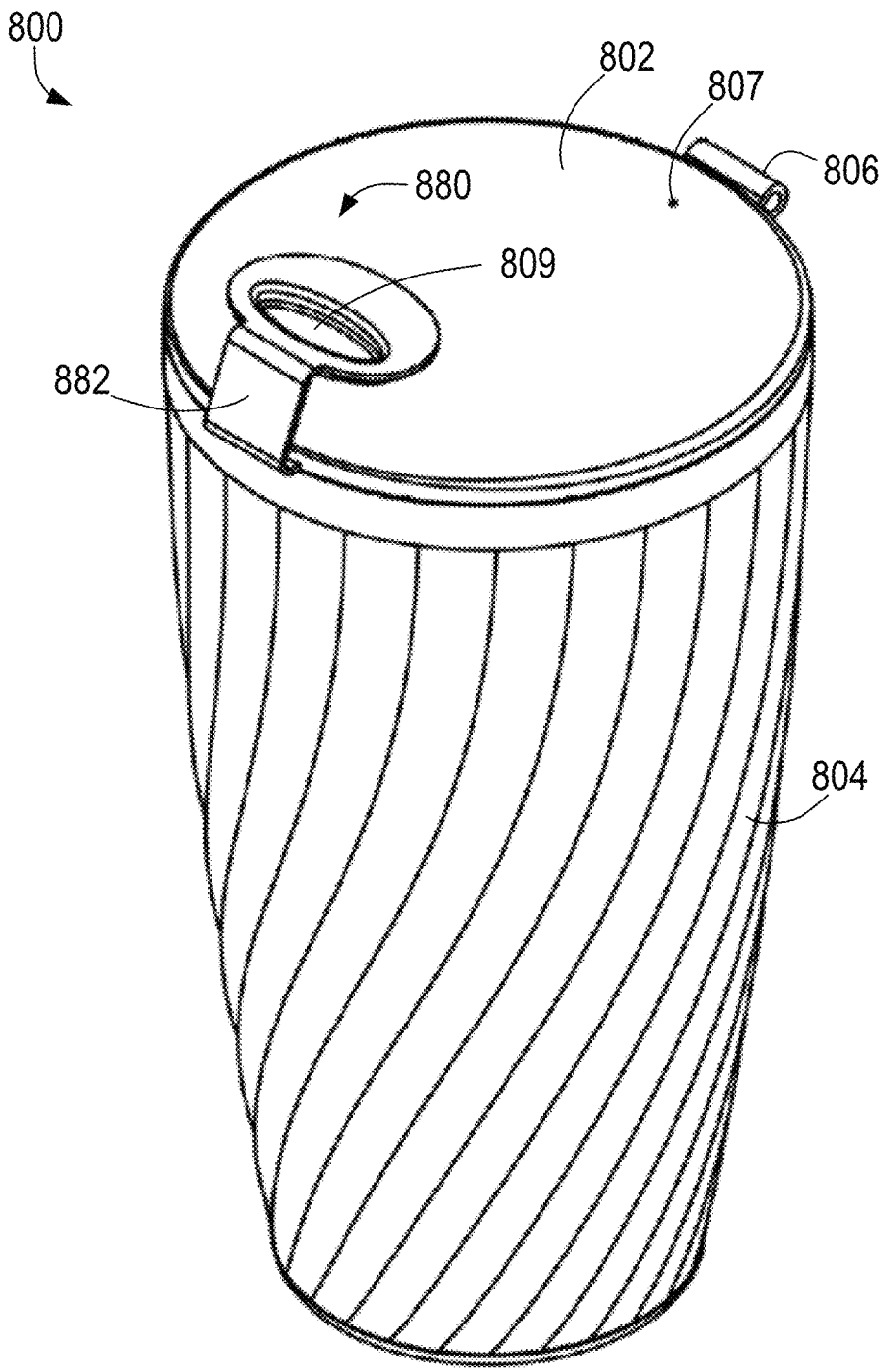
FIG. 35 depicts an example disposable cup with an integrated hinged lid having a hinged stopper, with the hinged lid and the hinged stopper in closed positions in accordance with one non-limiting embodiment.
Figure 36:
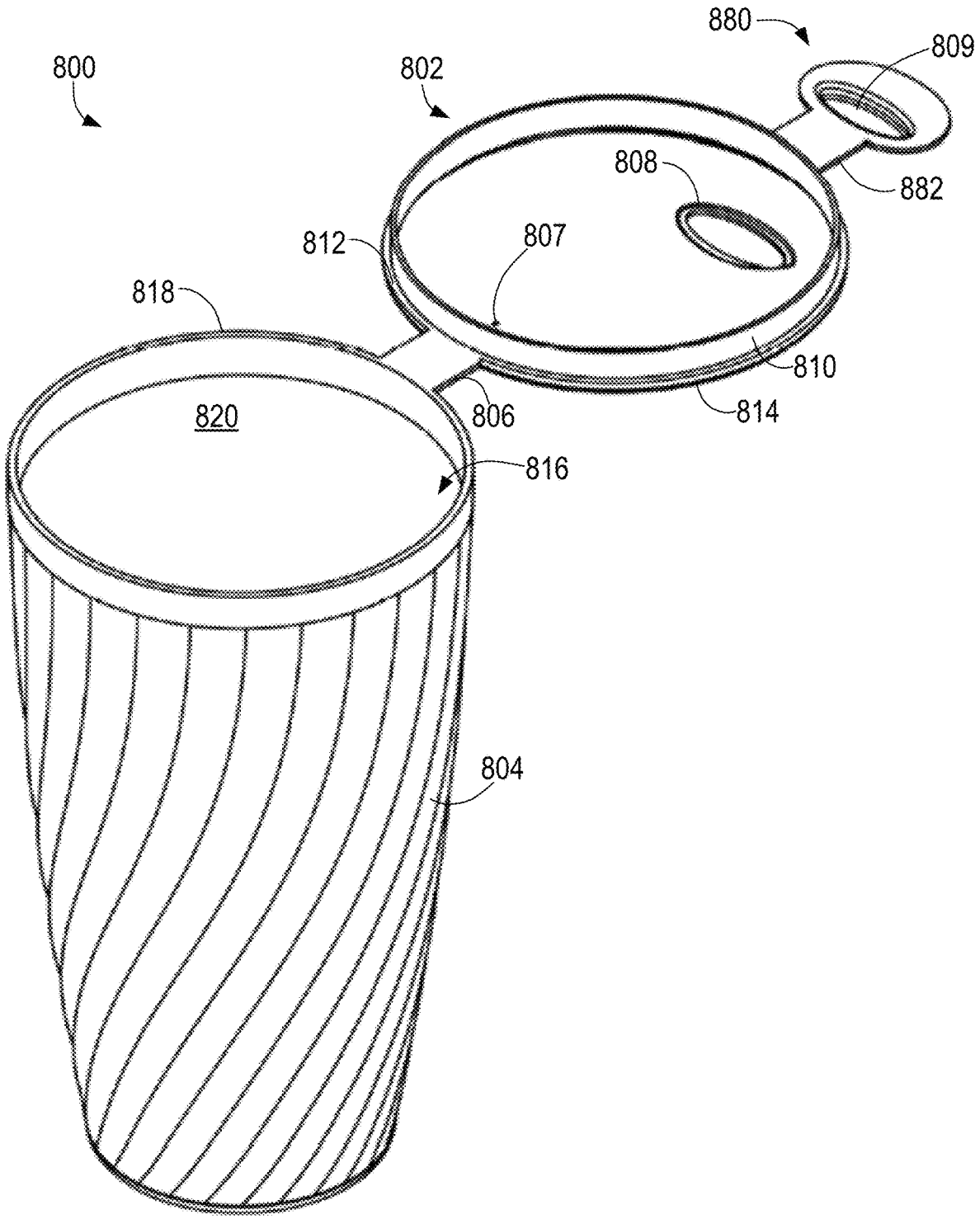
FIG. 36 depicts the disposable cup with an integrated hinged lid of FIG. 35 with the hinged lid and the hinged stopper in open positions in accordance with one non-limiting embodiment.
Figure 37:
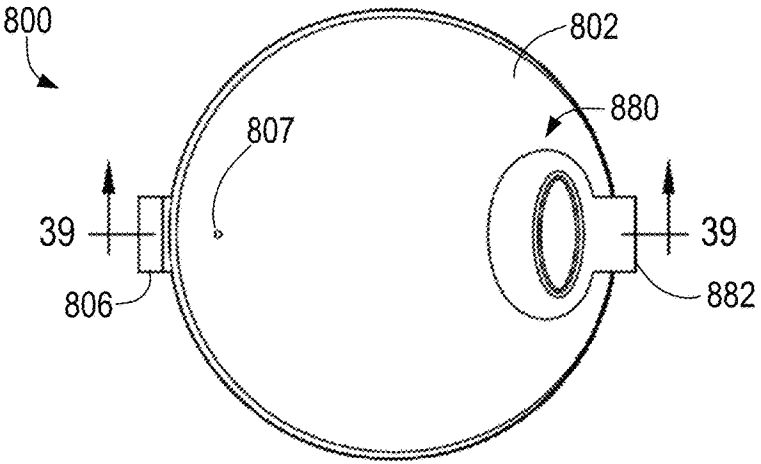
FIG. 37 depicts a top view of the example disposable cup with an integrated hinged lid of FIG. 35 in a closed position in accordance with one non-limiting embodiment.
Figure 38:
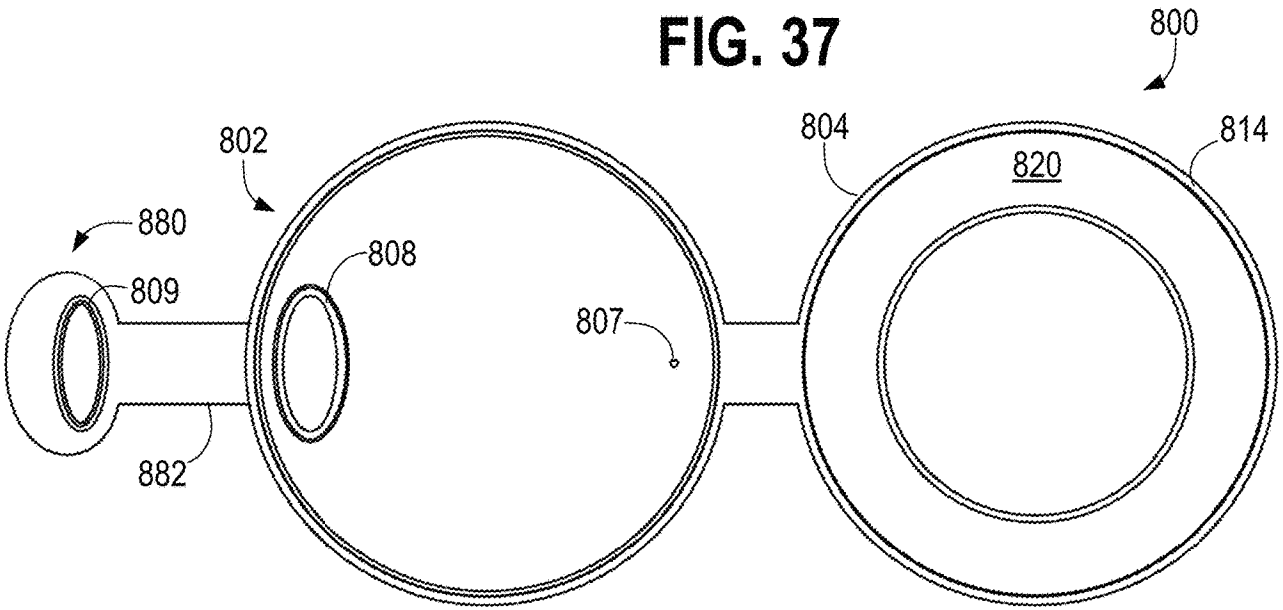
FIG. 38 depicts a top view of the example disposable cup with an integrated hinged lid of FIG. 35 in an open position in accordance with one non-limiting embodiment.
Figure 39:
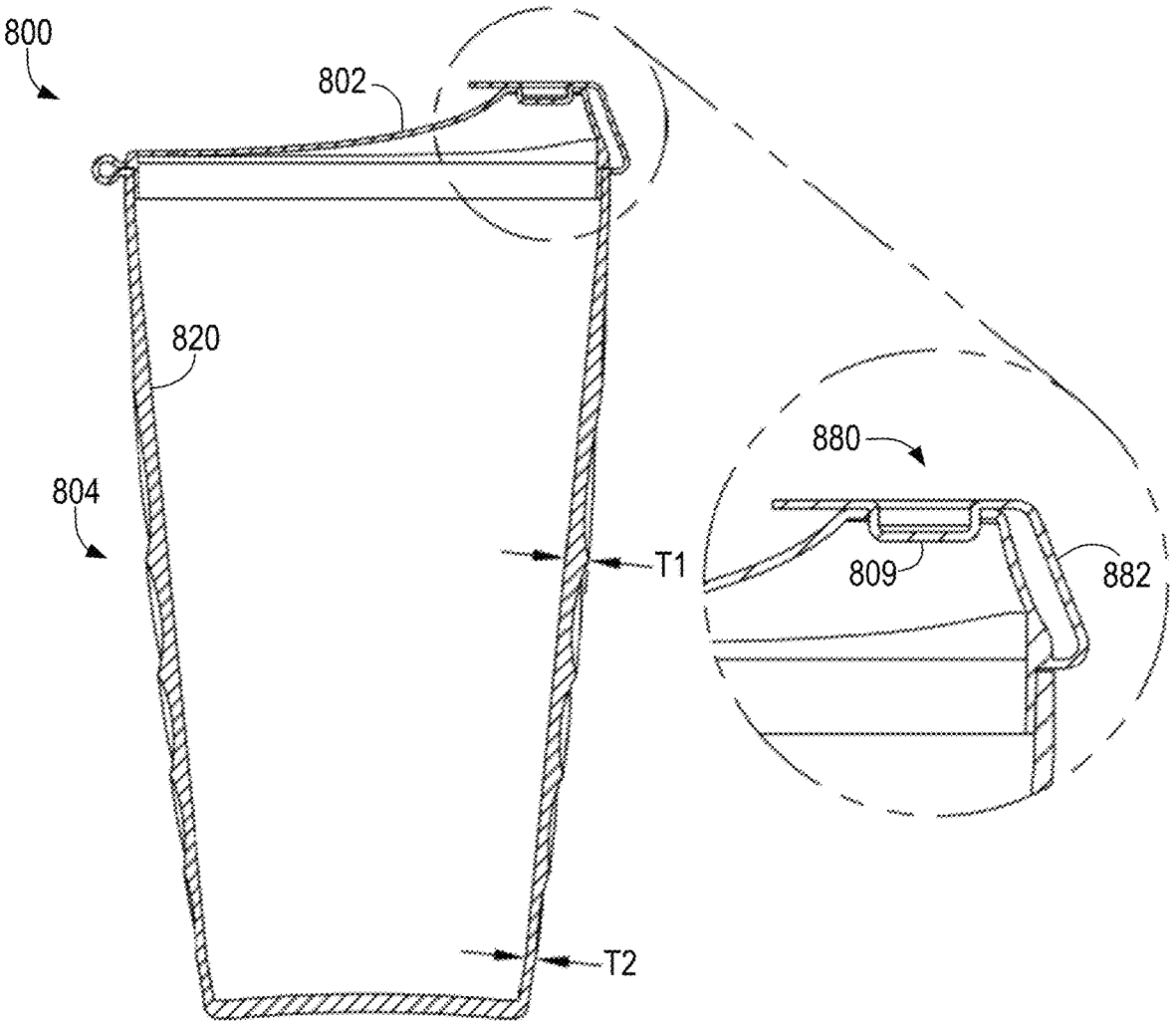
FIG. 39 is a cross-section view of the disposable cup with an integrated hinged lid of FIG. 37 taken through cross-section line 39-39.

FIGS. 35-39 depict another example disposable cup 800 with an integrated hinged lid 802 having a hinged stopper 880. FIG. 35 depicts the example disposable cup 800 with hinged lid 802 and the hinged stopper 880 in closed positions. FIG. 36 depicts the disposable cup 800 with the integrated hinged lid 802 in an open position. FIG. 37 depicts a top view of the disposable cup 800 with the hinged lid 802 in the closed position and the hinged stopper 880 in the closed position. FIG. 38 depicts a top view of the disposable cup 800 with the hinged lid 802 in the open position. FIG. 39 is a cross-section view of the disposable cup 800 of FIG. 37 taken through cross-section line 39-39.

Referring to FIGS. 35-39, the disposable cup 800 can include a body portion 804 having an inner surface 820. The inner surface 820 of the body portion 804 can define a cavity 816 that is fillable with liquid. The body portion 804 can be unlined and manufactured from a molded cellulosic material, for example. The disposable cup 800 can include the hinged lid 802 that is coupled to the body portion 804 via a hinge 806. In some embodiments, the hinge 806 is a living hinge that joins the outer edge of the hinged lid 802 to the body portion 804. The hinge 806 can be an integrally molded component made from a thin, flexible molded cellulosic material that is formed to function as a pivoting joint between the body portion 804 and the hinged lid 802. More specifically, the hinge 806 can be a flexible web of material formed during the molding manufacturing process, with the lid, hinge, and body portion comprising one continuous unitary product rather than separate components that are fastened together. The hinge 806 can have different configurations that allow for the functionality described herein. In any event, the hinge 806 can enable the hinged lid 802 to be repeatedly pivoted between an open and closed position while still retaining an attachment to the body portion 804.

In some embodiments, the hinged lid 802 defines a spout 808 and an air vent 807. A lower portion 810 of the hinged lid 802 can have a slightly smaller diameter than an upper portion 814, with the lower portion 810 and the upper portion 814 being separated by a shoulder 812 that surrounds the hinged lid 802. The shoulder 812 can have a width that is similar to the width of a rim 818 of the body portion 804. The hinge 806 can extend outwardly from the shoulder 812, as shown in FIG. 36.

In this embodiment, a hinged stopper 880 is movable between a closed position (FIG. 35) and an open position (FIG. 36) to selectively close the drinking spout 808. A stopper hinge 882 can be an integrally molded component made from a thin, flexible molded cellulosic material that is formed to function as a pivoting joint between the hinged stopper 880 and the hinged lid 802. The stopper hinge 882 can extend outwardly from the rim 818 of the lid 802, as shown in FIG. 36. In some embodiments, the stopper hinge 882 can be frangible, such that the hinged stopper 880 can be selectably detached from the lid 802 by a user. The hinged stopper 880 can also define a spout stopper 809 that generally aligns with and is received into the spout 808 of the hinged lid 802 when the hinged stopper 880 is in the closed configuration. Thus, while in the closed configuration, the spout stopper 809 is received into the spout 808 to seal the opening, as shown in FIGS. 35, 37, and 39.

In some embodiments, the external surface of the body portion 804 can be designed with various three-dimensional protrusions to enhance functionality and/or aesthetics. These features may include ribs, flutes, or other types of protrusions that create varying thicknesses around the body portion 804. While the illustrations in FIGS. 35-39 depict spiral flutes, this disclosure is not so limited. An example variation in thickness is depicted in FIG. 39, where the spiral flutes result in alternating thicker and thinner sections of the body portion 804, shown as T1 and T2, as described above. The placement and dimensions of the 3D protrusions can be configured to influence how users interact with the disposable cup 800.

Figure 40:
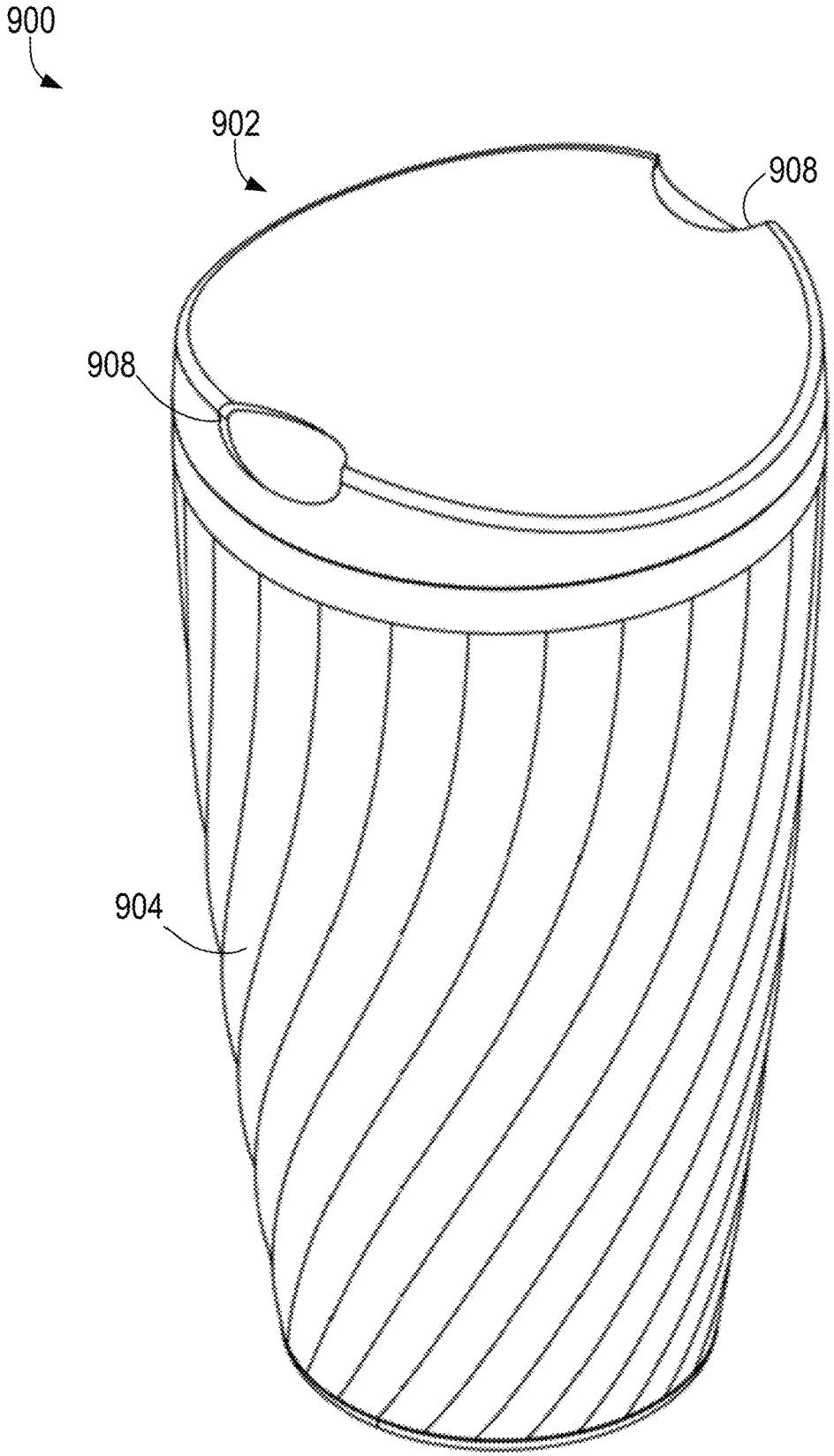
FIG. 40 depicts an example disposable cup with an integrated hinged lid having dual spouts in accordance with one non-limiting embodiment.
Figure 42:
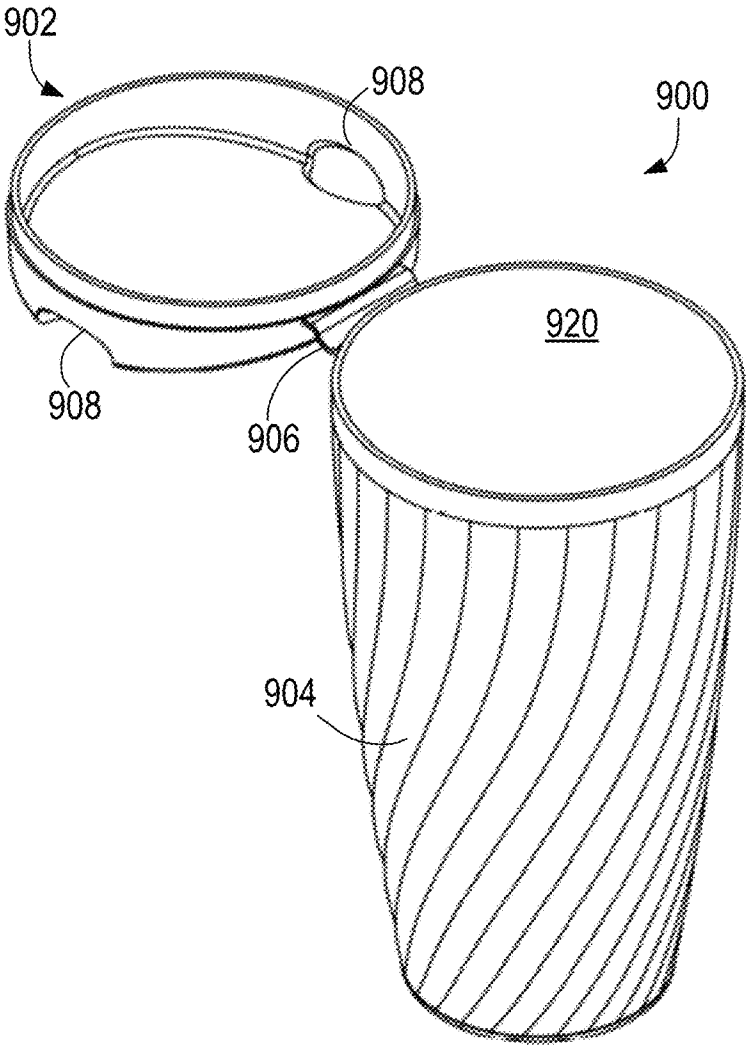
FIG. 42 depicts the example disposable cup with an integrated hinged lid of FIG. 40 in an open position in accordance with one non-limiting embodiment.
Figure 41:
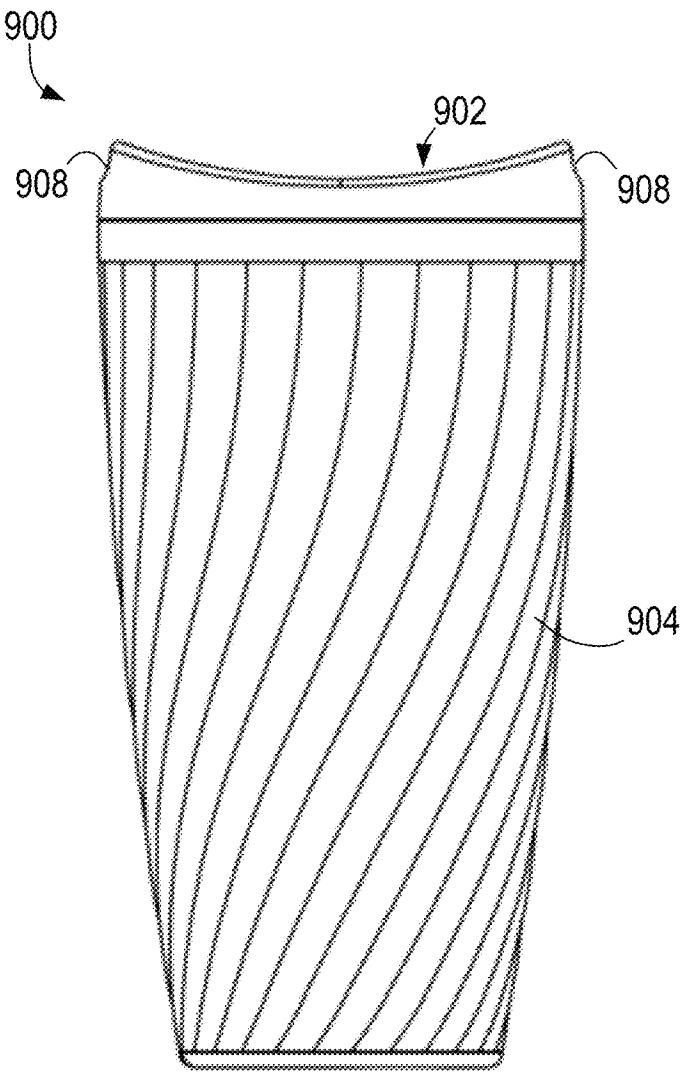
FIG. 41 depicts a side view of the example disposable cup of FIG. 40 in accordance with one non-limiting embodiment.

Referring now to FIGS. 40-42, another example disposable cup 900 with an integrated hinged lid 902 is depicted. FIG. 40 depicts the hinged lid 902 of the disposable cup 900 having dual spouts 908. FIG. 41 depicts a side view of the disposable cup 900 with the hinged lid 902 in the closed position. FIG. 42 depicts a side view of the disposable cup 900 with the hinged lid 902 in an open position. The disposable cup 900 can include a body portion 904 having an inner surface 920. The body portion 904 can be unlined and manufactured from a molded cellulosic material, for example. The disposable cup 900 can include the hinged lid 902 that is coupled to the body portion 904 via a hinge 906. In some embodiments, the hinge 906 is a living hinge that joins the outer edge of the hinged lid 902 to the body portion 904. The hinge 906 can be an integrally molded component made from a thin, flexible molded cellulosic material that is formed to function as a pivoting joint between the body portion 904 and the hinged lid 902. More specifically, the hinge 906 can be a flexible web of material formed during the molding manufacturing process, with the lid, hinge, and body portion comprising one continuous unitary product rather than separate components that are fastened together.

As shown, the hinged lid 902 can define opposing spouts 908. The spouts 908 can be placed on opposite ends of the hinged lid 902, thereby allowing for two people to share the disposable cup 900, without needing to consume the beverage from the same spout. Additionally, the unused spout 908 serves as an air vent when the opposing spout is being used. It is to be appreciated that the dual spout arrangement depicted in FIGS. 40-42 can be used with a variety of different lid configurations, including lid configurations that utilize hinged stoppers.

Figure 43:
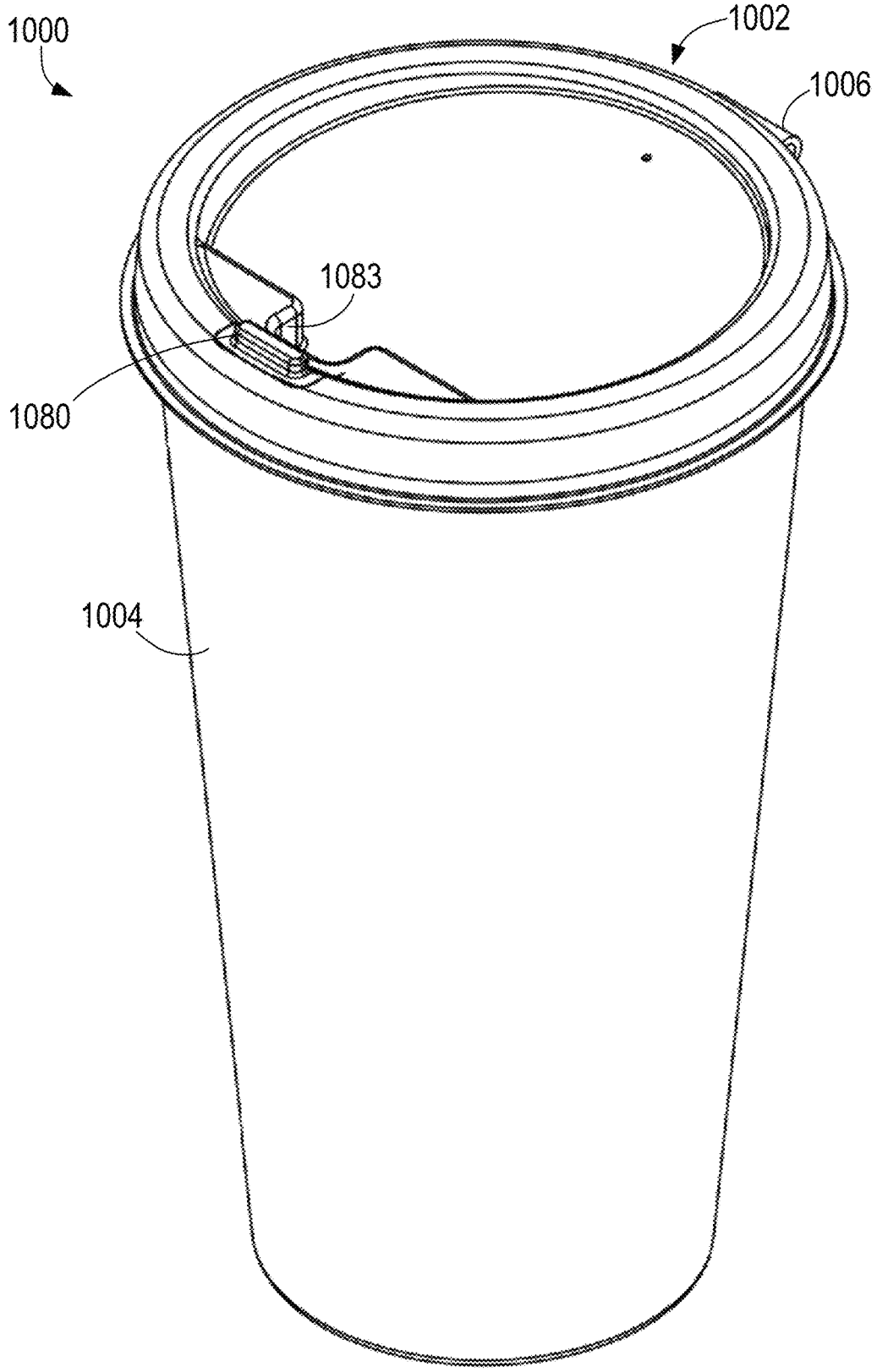
FIG. 43 depicts another example disposable cup in accordance with one non-limiting embodiment.
Figure 44:
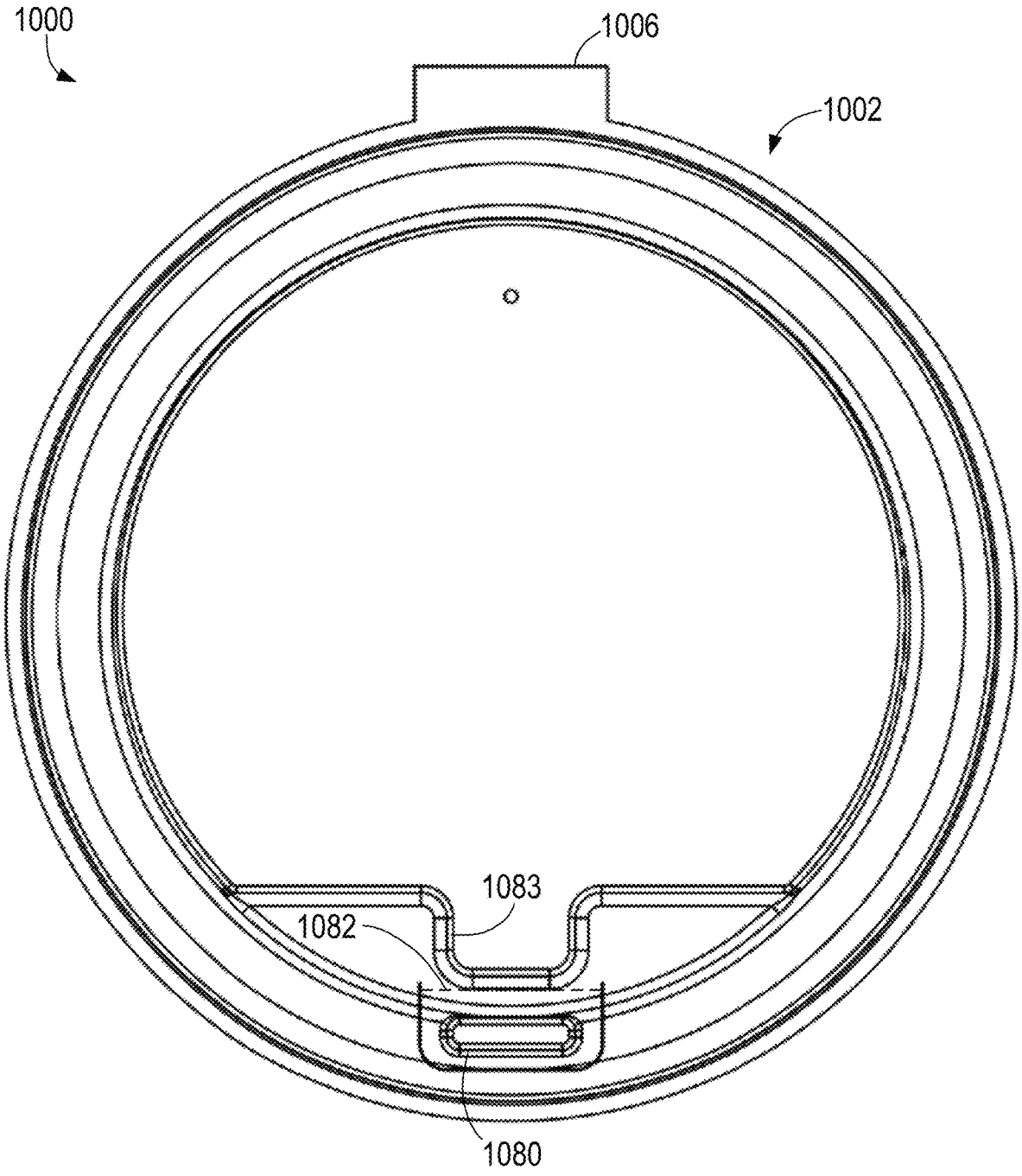
FIG. 44 depicts a top view of the disposable cup of FIG. 43 in accordance with one non-limiting embodiment.
Figure 45:
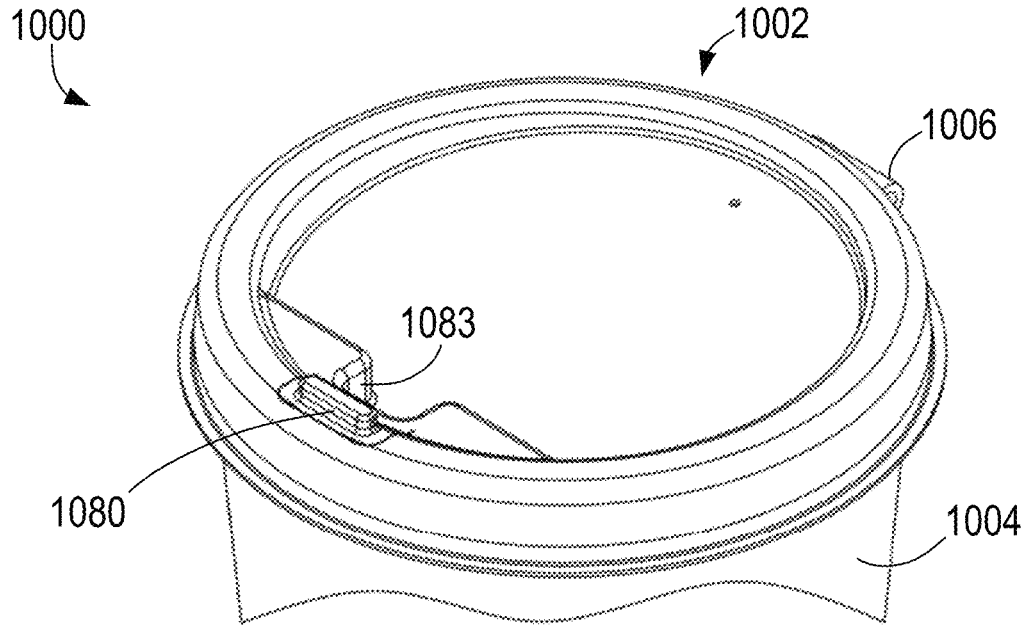
FIG. 45 is an enlarged view of the disposable cup in FIG. 43 with a hinged stopper in the closed position in accordance with one non-limiting embodiment.
Figure 46:
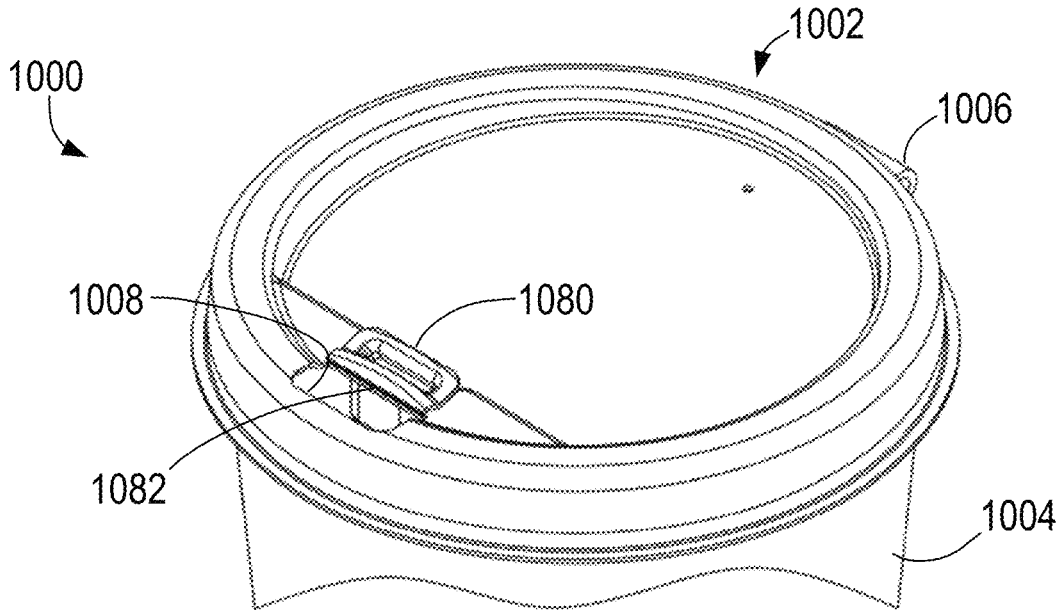
FIG. 46 is an enlarged view of the disposable cup in FIG. 43 with a hinged stopper in the open and docked position in accordance with one non-limiting embodiment.

FIGS. 43-46 depict another example disposable cup 1000 having a hinged stopper 1080 and an integrated hinged lid 1002. FIG. 43 depicts the disposable cup 1000 with the hinged stopper 1080 in the closed and sealed position. FIG. 44 depicts a top view of the disposable cup 1000 with the hinged stopper 1080 in the closed and sealed position. FIG. 45 is an enlarged view of the disposable cup 1000 in FIG. 43 with the hinged stopper 1080 in the closed and sealed position. FIG. 46 is an enlarged view of the disposable cup 1000 in FIG. 43 with the hinged stopper 1080 in the open and docked position. The disposable cup 1000 can include a body portion 1004 that is unlined and manufactured from a molded cellulosic material, for example. The disposable cup 1000 can include the hinged lid 1002 that is coupled to the body portion 1004 via a hinge 1006. In some embodiments, the hinge 1006 is a living hinge that joins the outer edge of the hinged lid 1002 to the body portion 1004. In other embodiments, however, the hinged lid 1002 may be separate from the disposable cup 1000.

The hinged lid 1002 can include the hinged stopper 1080 which is movable between a closed position (FIGS. 43-45) and an open position (FIG. 46). A stopper hinge 1082 can be an integrally molded component made from a thin, flexible molded cellulosic material that is formed to function as a pivoting joint between the hinged stopper 1080 and the hinged lid 1002. In some embodiments, the stopper hinge 1082 can be frangible, such that the hinged stopper 1080 can be selectably detached from the hinged lid 1002 by a user. The hinged lid 1002 can also define a dock 1083 that is sized to receive and retain the hinged stopper 1080. Thus, while in the open configuration, the hinged stopper 1080 remains docked in the dock 1083 such that a spout 1008 of the hinged lid 1002 remains open. In some embodiments, the hinged lid 1002 is manufactured with the stopper hinge 1082 in the closed position, as shown in FIG. 43. The stopper hinge 1082 can be maintained in the closed position by a frangible seal that can be broken by the user when the user wishes to access the spout 1008 and dock the hinged stopper 1080.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A disposable cup for holding liquid, comprising:

a body portion having a rim, wherein the body portion has an inner surface which at least partially defines a cavity, wherein the body portion does not have any additional coating or liner on its inner surface that contacts the liquid;

a lid defining a spout;

a hinge coupling the lid to the body portion, wherein the lid is movable between an open position and a closed position, wherein in the closed position the lid engages with the rim to form a liquid tight seal;

a hinged stopper, wherein the hinged stopper comprises a spout stopper, wherein the hinged stopper is movable between an open position and a closed position, wherein in the closed position the spout stopper is received into the spout;

a stopper hinge extending from the hinged stopper; and wherein the body portion, the lid, the hinge, and the hinged stopper are formed as a single unitary piece in a pulp molding operation, and wherein each of the body portion, the lid, the hinge, the hinged stopper, and the stopper hinge comprise a cellulosic material.

2. The disposable cup of claim 1, wherein the lid has an upper portion and a lower portion, and wherein the upper portion is separated from the lower portion by a shoulder.

3. The disposable cup of claim 2, wherein an outer diameter of the upper portion is greater than an outer diameter of the lower portion.

4. The disposable cup of claim 3, wherein the rim of the body portion has an inner diameter that is greater than the outer diameter of the lower portion and less than the outer diameter of the upper portion.

5. The disposable cup of claim 1, wherein the lid has an upper portion and a lower portion, and wherein the lower portion is received into the body portion when the lid is in the closed position.

6. The disposable cup of claim 1, wherein the stopper hinge couples the hinged stopper to the lid.

7. The disposable cup of claim 1, wherein the stopper hinge couples the hinged stopper to the body portion.

8. The disposable cup of claim 1, wherein the hinge coupling the lid to the body portion is frangible.

9. The disposable cup of claim 1, wherein the disposable cup is recyclable by a single recycling process.

10. A disposable cup for holding liquid, comprising:

a body portion having a rim, wherein the body portion has an inner surface which at least partially defines a cavity, wherein the body portion does not have any additional coating or liner on its inner surface that contacts the liquid, wherein the body portion comprises a plurality of outwardly extending protrusions, and wherein the body portion varies in thickness;

a lid defining a spout;

a hinge coupling the lid to the body portion, wherein the lid is movable between an open position and a closed position, wherein in the closed position the lid engages with the rim to form a liquid tight seal; and wherein the body portion, the plurality of outwardly extending protrusions, the lid, and the hinge are formed as a single unitary piece in a pulp molding operation, and wherein each of the body portion, the lid, and the hinge comprise a cellulosic material.

11. The disposable cup of claim 10, wherein the plurality of outwardly extending protrusions comprise spiral flutes.

12. The disposable cup of claim 10, wherein the plurality of outwardly extending protrusions comprise ribs.

13. The disposable cup of claim 10, further comprising a hinged stopper, wherein the hinged stopper comprises a spout stopper, wherein the hinged stopper is movable between an open position and a closed position, wherein in the closed position the spout stopper is received into the spout.

14. The disposable cup of claim 13, wherein a stopper hinge couples the hinged stopper to the lid.

15. The disposable cup of claim 13, wherein a stopper hinge couples the hinged stopper to the body portion.

16. The disposable cup of claim 10, wherein the body portion, the plurality of outwardly extending protrusions, the lid, and the hinge are formed of a molded cellulosic material.

17. The disposable cup of claim 10, wherein the disposable cup is recyclable by a single recycling process.

18. A disposable cup for holding liquid, comprising:

a body portion having a rim, wherein the body portion has an inner surface which at least partially defines a cavity, wherein the body portion does not have any additional coating or liner on its inner surface that contacts the liquid, wherein the body portion comprises a plurality of outwardly extending protrusions, and wherein the body portion varies in thickness;

a lid defining at least one spout;

a hinge coupling the lid to the body portion, wherein the lid is movable between an open position and a closed position, wherein in the closed position the lid engages with the rim to form a liquid tight seal;

a hinged stopper, wherein the hinged stopper comprises a spout stopper, wherein the hinged stopper is movable between an open position and a closed position, wherein in the closed position the spout stopper is received into the spout;

wherein the body portion, the lid, the hinge, and the hinged stopper are formed as a single unitary piece in a pulp molding operation, and wherein each of the body portion, the lid, the hinge, and the hinged stopper comprise a cellulosic material; and wherein the disposable cup is recyclable by a single recycling process.

* * * * *